US011574782B2

(12) United States Patent
Choi et al.

(10) Patent No.: US 11,574,782 B2
(45) Date of Patent: Feb. 7, 2023

(54) SWITCHING DEVICE

(71) Applicant: ALPS ALPINE CO., LTD., Tokyo (JP)

(72) Inventors: Yeonjo Choi, Gwangju (KR); Inseob Kang, Gwangju (KR)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 17/649,828

(22) Filed: Feb. 3, 2022

(65) Prior Publication Data

US 2022/0293365 A1 Sep. 15, 2022

(30) Foreign Application Priority Data

Mar. 9, 2021 (JP) ..... JP2021-037654

(51) Int. Cl.
*H01H 25/00* (2006.01)

(52) U.S. Cl.
CPC ..... *H01H 25/008* (2013.01); *H01H 2221/016* (2013.01); *H01H 2225/01* (2013.01); *H01H 2233/074* (2013.01)

(58) Field of Classification Search
CPC ..... H01H 25/008; H01H 2221/016; H01H 25/00; H01H 25/04; H01H 25/06; H01H 2025/048
USPC ..... 200/4, 5 R, 6 a, 6 r, 17 r, 18, 329
See application file for complete search history.

(56) References Cited

U.S. PATENT DOCUMENTS

2014/0043303 A1* 2/2014 Baker ..... G05G 9/047 345/184
2015/0318128 A1* 11/2015 Noh ..... H01H 25/06 200/4

FOREIGN PATENT DOCUMENTS

JP 2006-228452 8/2006

* cited by examiner

*Primary Examiner* — Edwin A. Leon
*Assistant Examiner* — Iman Malakooti
(74) *Attorney, Agent, or Firm* — IPUSA, PLLC

(57) ABSTRACT

A switching device includes a first knob to receive a pressing operation in a first direction; a pressing detection switch to be pressed upon transmission of an operating force of the pressing operation; a decorative member to decorate a periphery of the first knob, that includes an engaged portion; and a holder to engage and hold the decorative member, that includes an engaging portion to engage the engaged portion. In response to the pressing operation by a first stroke amount, by the operating force transmitted to the pressing detection switch without transmitted to the engaged portion, the pressing detection switch is pressed. In response to the pressing operation by a second stroke amount greater than the first stroke amount, by the operating force applied to the first knob being transmitted to the engaged portion, the engaged portion elastically deforms, and engagement of the engaging/engaged portions is released.

14 Claims, 37 Drawing Sheets

SWITCHING DEVICE

CROSS-REFERENCE TO RELATED APPLICATIONS

The present application is based upon and claims priority under 35 U.S.C. § 119 to Japanese Patent Application No. 2021-037654 filed on Mar. 9, 2021, the entire contents of which are incorporated herein by reference.

BACKGROUND OF THE INVENTION

1. Field of the Invention

The present disclosure relates to a switching device.

2. Description of the Related Art

Conventionally, in switching devices used for power windows and the like of vehicles, a technique has been used in which a rotary knob that receives an operation from the operator is attached to an attachment-affixed member by a snap-in structure (see, for example, Japanese Laid-Open Patent Application No. 2006-228452).

However, in the conventional switching device, when removing the rotary knob from the attachment-affixed member, it is necessary to apply a strong force to the rotary knob to release the engaging condition of the engaging portion of the rotary knob and the attachment-affixed member; therefore, it is not easy to remove the rotary knob, and the engaging portion of the rotary knob may be damaged or deformed.

SUMMARY OF THE INVENTION

According to one aspect in the present disclosure, a switching device includes a first knob configured to receive a pressing operation in a first direction; a pressing detection switch configured to be pressed upon transmission of an operating force of the pressing operation applied to the first knob; a decorative member configured to decorate a periphery of the first knob; and a holder configured to engage and hold the decorative member, wherein decorative member includes an engaged portion, wherein the holder includes an engaging portion to engage the engaged portion, wherein in response to the pressing operation being performed on the first knob by a first stroke amount, by the operating force of the pressing operation applied to the first knob being transmitted to the pressing detection switch without transmitted to the engaged portion, the pressing detection switch is pressed, and wherein in response to the pressing operation being performed on the first knob by a second stroke amount greater than the first stroke amount, by the operating force of the pressing operation applied to the first knob being transmitted to the engaged portion, the engaged portion elastically deforms, and an engaging state of the engaging portion and the engaged portion is released.

DESCRIPTION OF THE PREFERRED EMBODIMENTS

In the following, with reference to the drawings, one embodiment will be described.

According to the one embodiment, while preventing damage and defamation of the engaging portion, the decorative member of a switching device can be easily removed.

Note that the decorative member in the present application corresponds to a conventional rotary knob of a switching device.

(Summary of Switching Device 100)

Figure 1:
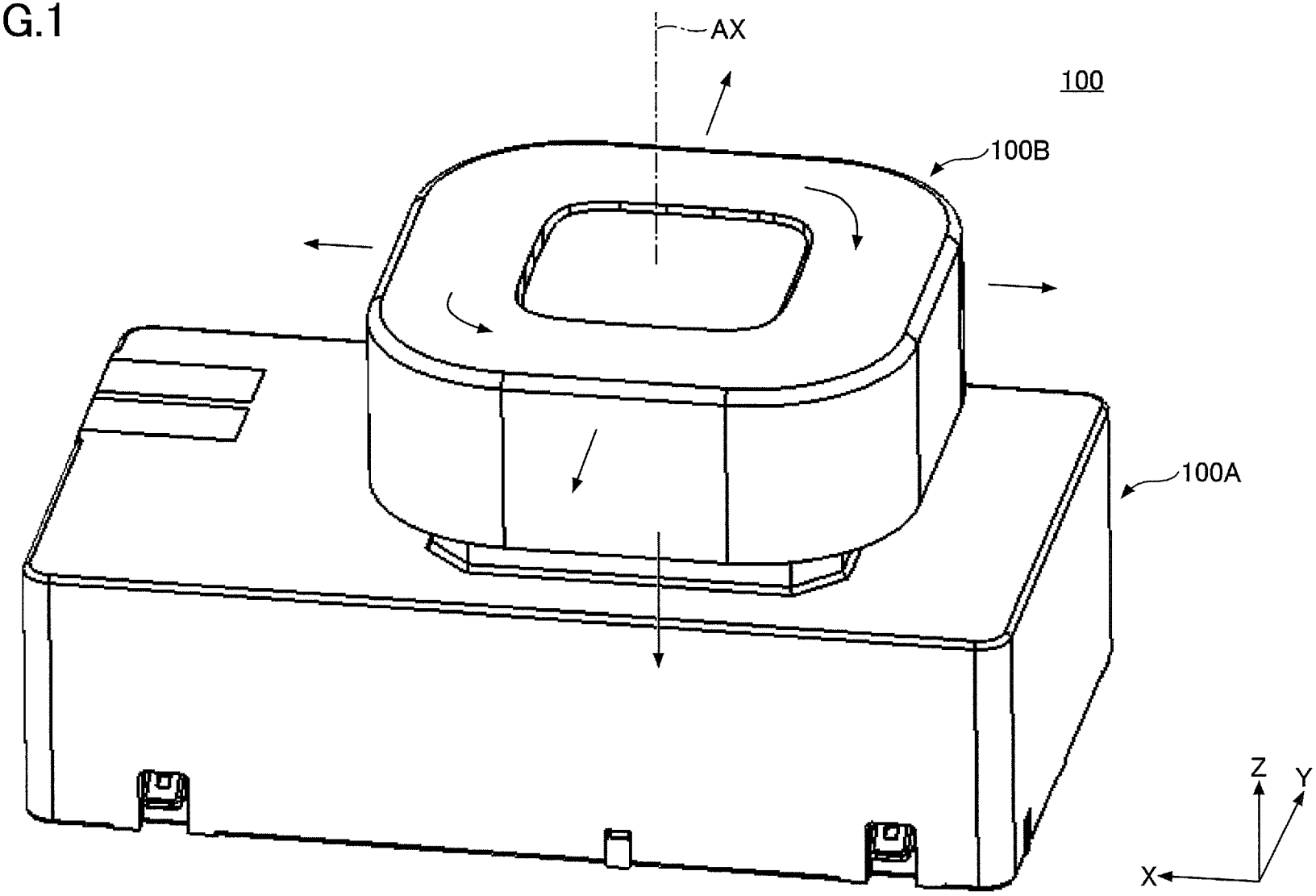
FIG. 1 is an external perspective view of a switching device according to one embodiment.

FIG. 1 is an external perspective view of a switching device 100 according to the one embodiment. Note that in the following description, for the sake of convenience, the X-axis direction is taken in the forward-and-backward direction; the Y-axis direction is taken in the left-and-right direction; and the Z-axis direction is taken in the up-and-down direction. Here, the X-axis positive direction is taken as the forward direction; the Y-axis positive direction is taken as the rightward direction; and the Z-axis positive direction is taken as the upward direction. Note that the Z-axis direction is an example of a first direction in the claims. Note that the X-axis direction and the Y-axis direction are examples of a sliding direction in the claims.

The switching device 100 illustrated in FIG. 1 can be used as a switching device for performing an operation on an in-vehicle device (e.g., an electric power sheet) installed in a vehicle, for example, an automobile or the like. As illustrated in FIG. 1, the switching device 100 has a main body 100A having a shape of a rectangular parallelepiped, and an operation part 100B protruding upward from the top surface of the main body 100A. The switching device 100 allows the operator to perform one of a pushdown operation, a sliding operation, and a rotating operation on the operation part 100B.

Specifically, on the switching device 100, a pushdown operation in the downward direction along the central axis AX (the Z-axis negative direction) can be performed on the operation part 100B.

Also, on the switching device 100, a sliding operation can be performed on the operation part 100B in each of the forward direction (the X-axis positive direction), the backward direction (the X-axis negative direction), the rightward direction (the Y-axis positive direction), and the leftward direction (the Y-axis negative direction) that are orthogonal to the central axis AX.

Also, on the switching device 100, a rotating operation can be performed on the operation part 100B in each of the clockwise direction and the counterclockwise direction around the central axis AX as the center of rotation.

(Configuration of the Switching Device 100)

Figure 2:
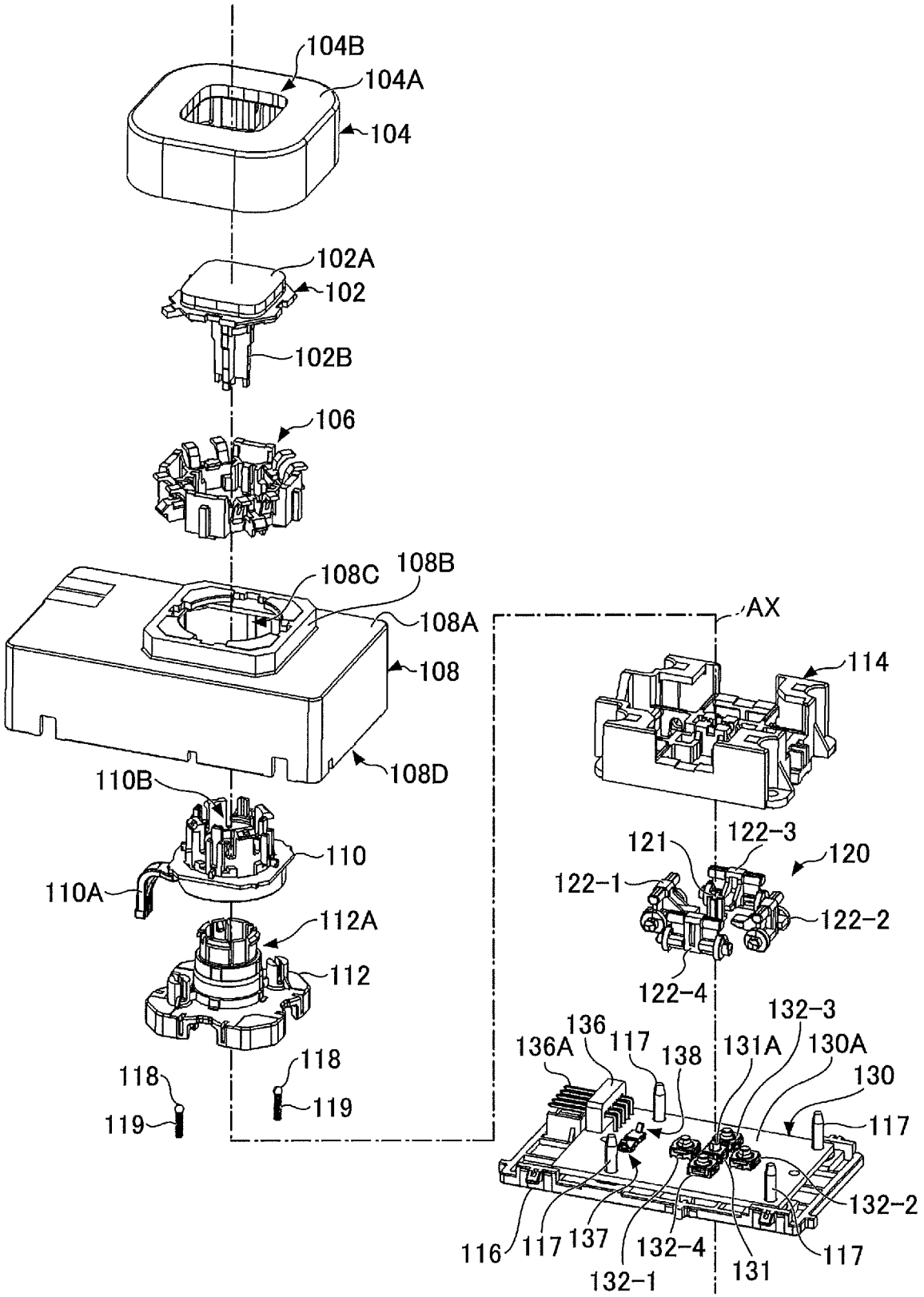
FIG. 2 is an exploded perspective view of the switching device according to the one embodiment.
Figure 3:
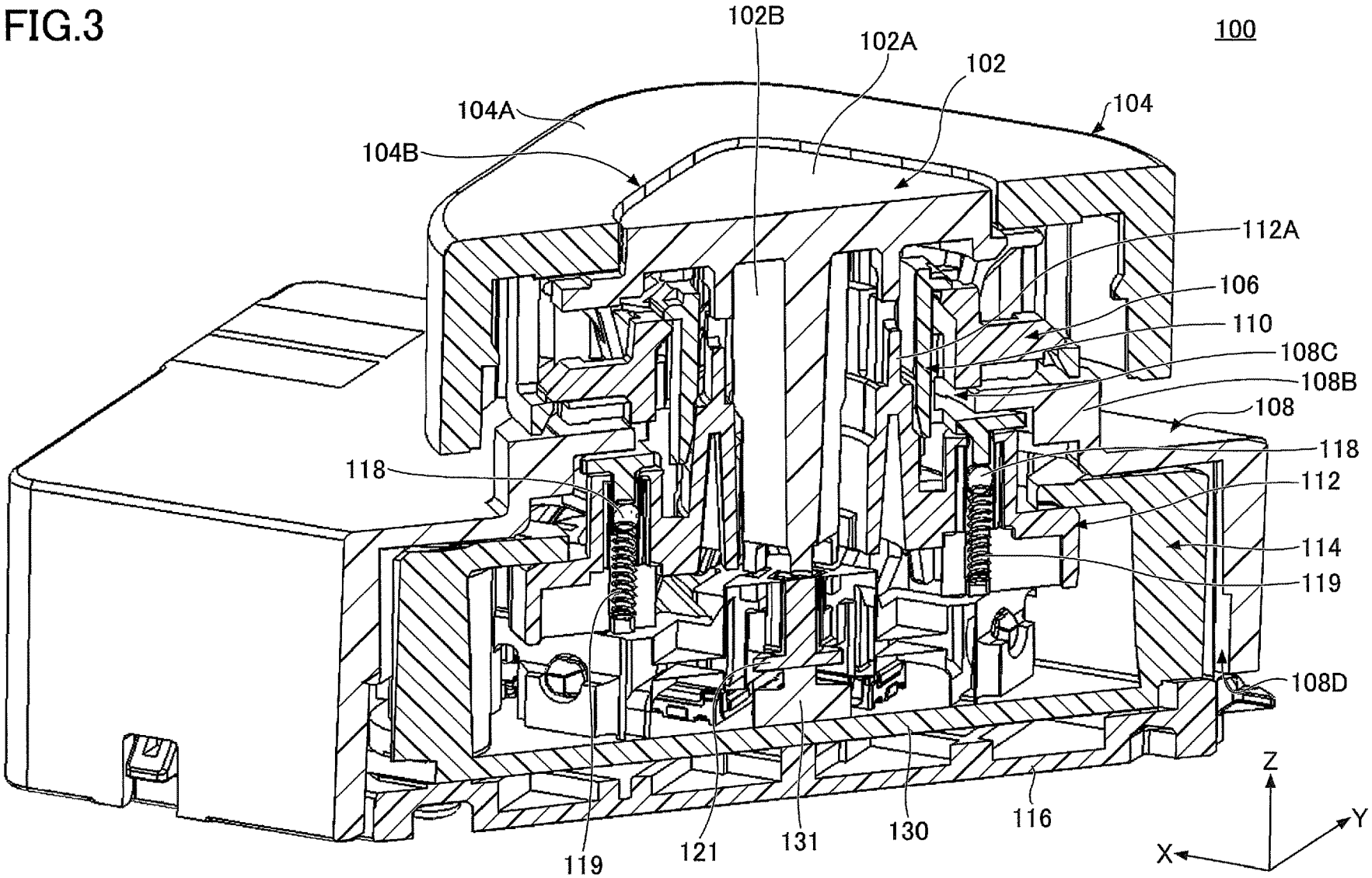
FIG. 3 is a perspective cross-sectional view of the switching device according to the one embodiment.
Figure 4:
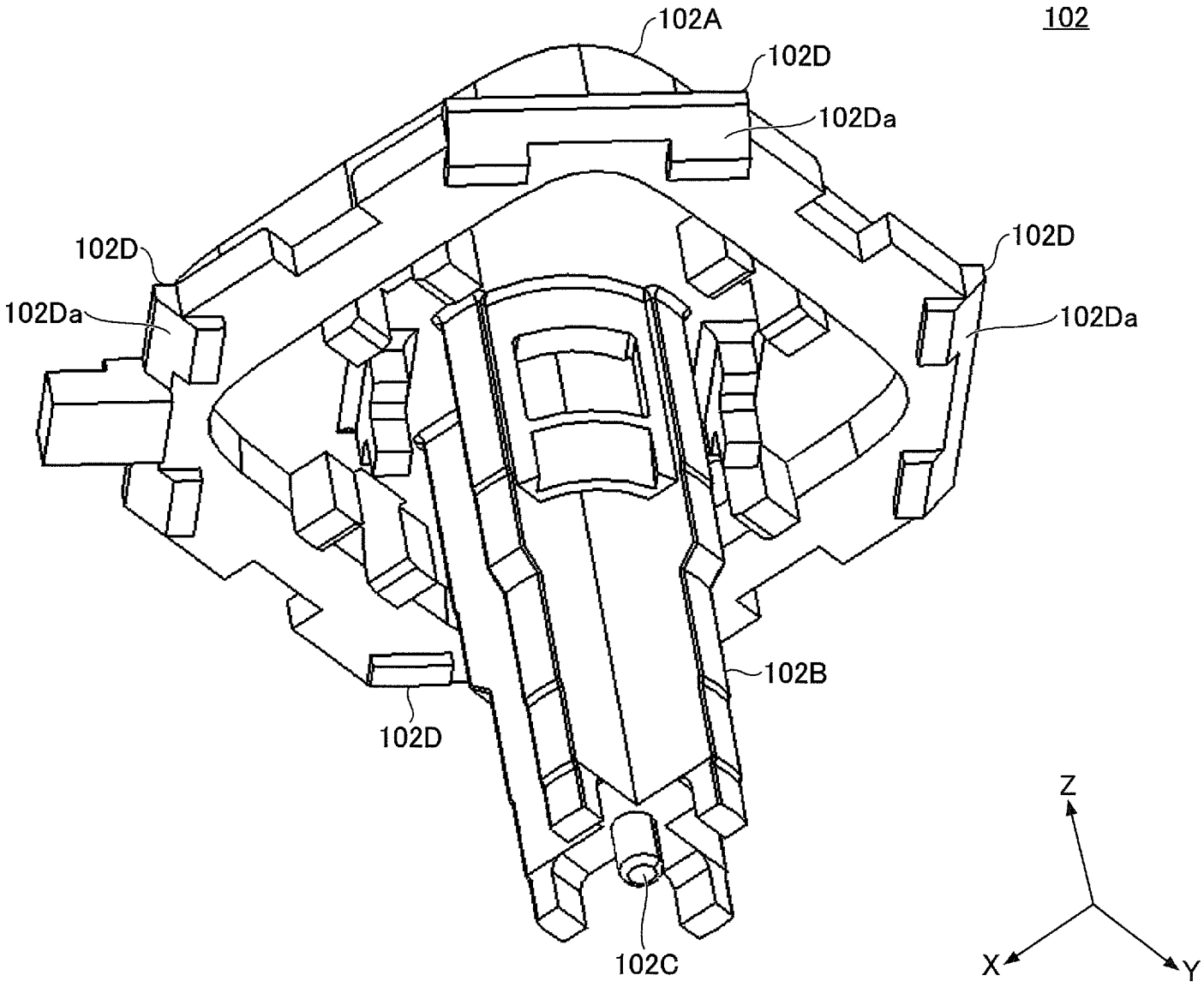
FIG. 4 is an external perspective view of a knob provided in the switching device as viewed on the lower side (the Z-axis negative side) according to the one embodiment.
Figure 5:
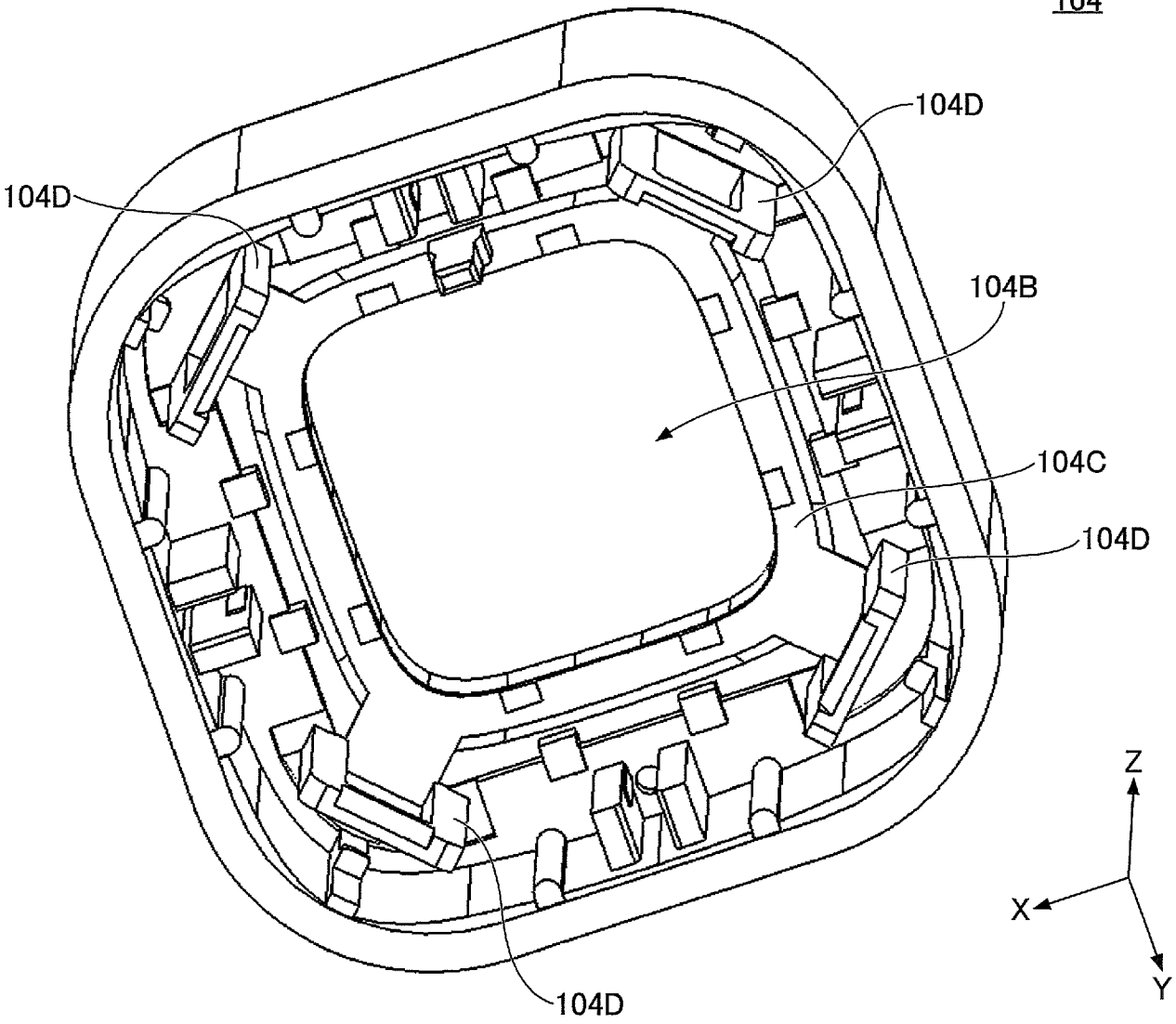
FIG. 5 is an external perspective view of a decorative member provided in the switching device as viewed on the lower side (the Z-axis negative side) according to the one embodiment.
Figure 6:
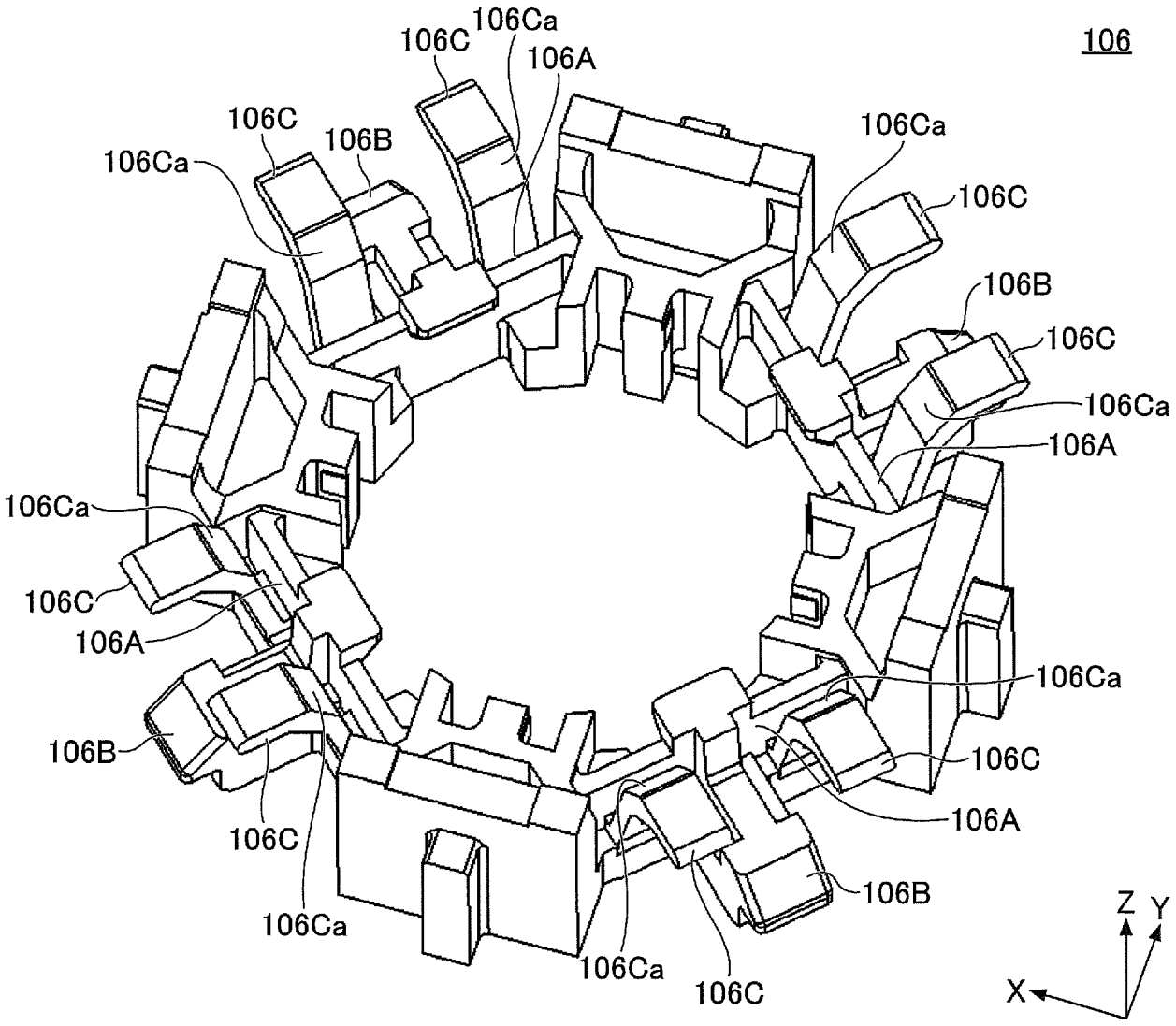
FIG. 6 is an external perspective view of a first holder provided in the switching device according to the one embodiment.

FIG. 2 is an exploded perspective view of the switching device 100 according to the one embodiment. FIG. 3 is a perspective cross-sectional view of the switching device 100 according to the one embodiment. FIG. 4 is an external perspective view of a knob 102 provided in the switching device 100 as viewed on the lower side (the Z-axis negative side) according to the one embodiment. FIG. 5 is an external perspective view of a decorative member 104 provided in the switching device 100 as viewed on the lower side (the Z-axis negative side) according to the one embodiment. FIG. 6 is an external perspective view of a first holder 106 provided in the switching device 100 according to the one embodiment.

<Configuration of the Operation Part 100B>

As illustrated in FIG. 2, the switching device 100 includes the knob 102, the decorative member 104, and the first holder 106. The knob 102, the decorative member 104, and the first holder 106 are component members of the operation part 100B illustrated in FIG. 1.

The knob 102 is a member made of resin to receive a pushdown operation performed by the operator. The knob 102 is an example of a "first knob". The knob 102 includes, at the topmost portion, an operation part 102A that has a horizontally flat plate shape, and a rectangular shape in plan view. Also, the knob 102 includes a shaft portion 102B extending downward (in the Z-axis negative direction) from the center of the bottom surface of the operation part 102A. The shaft portion 102B is inserted into the inside of a ring shape formed by the first holder 106, and into an opening portion 108C of a case 108. As illustrated in FIG. 4, a protruding part 102C having a circular column shape is provided at the center of the lower end of the shaft portion 102B protruding downward (in the Z-axis negative direction). When a pushdown operation is performed, the shaft portion 102B presses a pressing detection switch 131 by the protruding part 102C via an actuator 121 inside the case 108. Also, as illustrated in FIG. 4, at each of the four corners of the operation part 102A of the knob 102, a protruding part 102D protruding outward is provided. The protruding part 102D includes a pressing surface 102Da that is inclined downward and outward. Note that in the present embodiment, although a tact switch having a metal dome contact and a presser (a rubber stem) is used as the pressing detection switch formed of a relatively rigid rubber material that can be elastically deformed upon being applied with an overload, the pressing detection switch does not need to be a tact switch. The pressing detection switch has a returning force.

The decorative member 104 is a member that imparts a decoration around the knob 102. The decorative member 104 is a member that functions as a "second knob" to receive a sliding operation and a rotating operation (examples of "another operation different from a pressing operation") in the forward-and-backward/left-and-right directions from the operator. The decorative member 104 has a shape of roughly a rectangular parallelepiped, and the four sides forming the shape of the rectangular parallelepiped are provided to correspond to the forward direction, the backward direction, the leftward direction, and the rightward direction. Therefore, the operator holding the decorative member 104 can intuitively recognize the direction in which a sliding operation is to be performed. Surface finishing or the like may be applied to part of or the entirety of the surface of the decorative member 104, to increase the decorative property (not illustrated). The decorative member 104 may be engaged with a separate member to which plating or a special paint is applied. Although it is favorable that the decorative member 104 is formed of a material that includes a resin as the main component, part of or the entirety of the decorative member 104 may be formed of metal. The decorative member 104 includes an opening portion 104B having a rectangular shape in plan view, at the center of the top surface 104A. The operation part 102A of the knob 102 is arranged in the opening portion 104B. The decorative member 104 is configured to be attachable or detachable with respect to the first holder 106. In other words, in the switching device 100, the decorative member 104 attached to the first holder 106 can be selectively replaced with a member from among multiple decorative members 104 having different decorative designs. As illustrated in FIG. 5, at each of the four corners of the ceiling surface 104C inside the decorative member 104, a hook 104D hanging down from the ceiling surface 104C is provided (an example of an "engaged portion"). The decorative member 104 is engaged with and held by the first holder 106, by having each of the four hooks 104D engaged with a corresponding one of four engaging claws 106B included in the first holder 106.

The first holder 106 is a member made of resin to hold the knob 102 and the decorative member 104. The first holder 106 holds the knob 102 so as to be slidable in the up-and-down direction (the Z-axis direction) on the inside of a ring shape famed by the first holder 106. Also, as illustrated in FIG. 6, an engaging claw 106B is included in the first holder 106 protruding outward on each of four side surfaces 106A arranged at equal intervals (90-degree intervals). The first holder 106 holds the decorative member 104 engaged with the four engaging claws 106B on the outside of the ring shape formed by the first holder 106. Also, as illustrated in FIG. 6, each of the four first holders 106 is provided with a pair of lever portions 106C between which the engaging claw 106B is interposed. Each of the lever portions 106C extends upward (in the Z-axis positive direction) from the side surface 106A, and has a lever shape bent on the outside. Each of the lever portions 106C includes a pressed surface 106Ca that is inclined upward and inward. As illustrated in FIGS. 2, 3, 7 to 9, 33, and 34, the knob 102 and the first holder 106 are arranged to overlap in the up-and-down direction, and arranged at positions that overlap in plan view. Also, when no pressing operation is performed, in the up-and-down direction, the knob 102 and the first holder 106 are arranged to be separated by an interval equivalent to the first stroke amount. Also, the pressing surface 102Da of the knob 102 and the pressed surface 106Ca of the first holder 106 are arranged at positions that overlap in plan view. Also, in the up-and-down direction, the pressing surface 102Da and the pressed surface 106Ca are arranged to be separated by an interval equivalent to the first stroke amount. Also, the distance between the pressing surface 102Da and the pressed surface 106Ca in the up-and-down direction is less than a limiting dimension of the stroke amount in the up-and-down direction of the knob 102 upon receiving a pushdown operation. Therefore, when the knob 102 receives a pressing operation, in each of the lever portions 106C, the pressed surface 106Ca is biased by the protruding part 102D (the pressing surface 102Da) of the knob 102 from the upside and the pressing force is transmitted. The shapes of the pressing surface 102Da and the pressed surface 106Ca are tilted with respect to the up-and-down direction (the Z-axis direction); therefore, the pressing force from the knob 102 is converted to a biasing force in the horizontal direction (the XY-plane direction). Thus, each of the lever portions 106C elastically deforms in an outward direction.

<Configuration of the Main Body 100A>

Also, as illustrated in FIG. 2, the switching device 100 includes a case 108, a second holder 110, a slider 112, a subcase 114, an actuator unit 120, a substrate 130, and a cover 116. The case 108, the second holder 110, the slider 112, the subcase 114, the actuator unit 120, the substrate 130, and the cover 116 are component members of the main body 100A illustrated in FIG. 1.

The case 108 is a container-shaped member made of resin that has a shape of roughly a rectangular parallelepiped and a hollow structure. In the interior of the case 108, the second holder 110, the slider 112, the subcase 114, the actuator unit 120, and the substrate 130 are housed. A pedestal 108B having a constant height is formed on a top surface 108A of the case 108. An opening portion 108C of a circular shape having the central axis AX at the center in plan view, is formed in the pedestal 108B. A shaft portion 102B of the knob 102 is inserted into the opening portion 108C. Also, the entirety of a portion corresponding to the bottom surface of the case 108 forms a lower opening portion 108D. The lower opening portion 108D is closed by the cover 116.

Note that a configuration of the second holder 110 will be described later with reference to FIGS. 10 to 12. Also, a configuration of the slider 112, the subcase 114, the actuator unit 120. and the substrate 130 will be described later with reference to FIGS. 13 to 20.

The cover 116 is a member made of resin and having a flat plate shape, to close the lower opening portion 108D of the case 108. The cover 116 is fixed to the case 108 by four screws 117 penetrating through the cover 116.

(Disengagement Operation)

Next, with reference to FIGS. 7 to 9, disengagement operations on the switching device 100 according to the one embodiment will be described.

Figure 7:
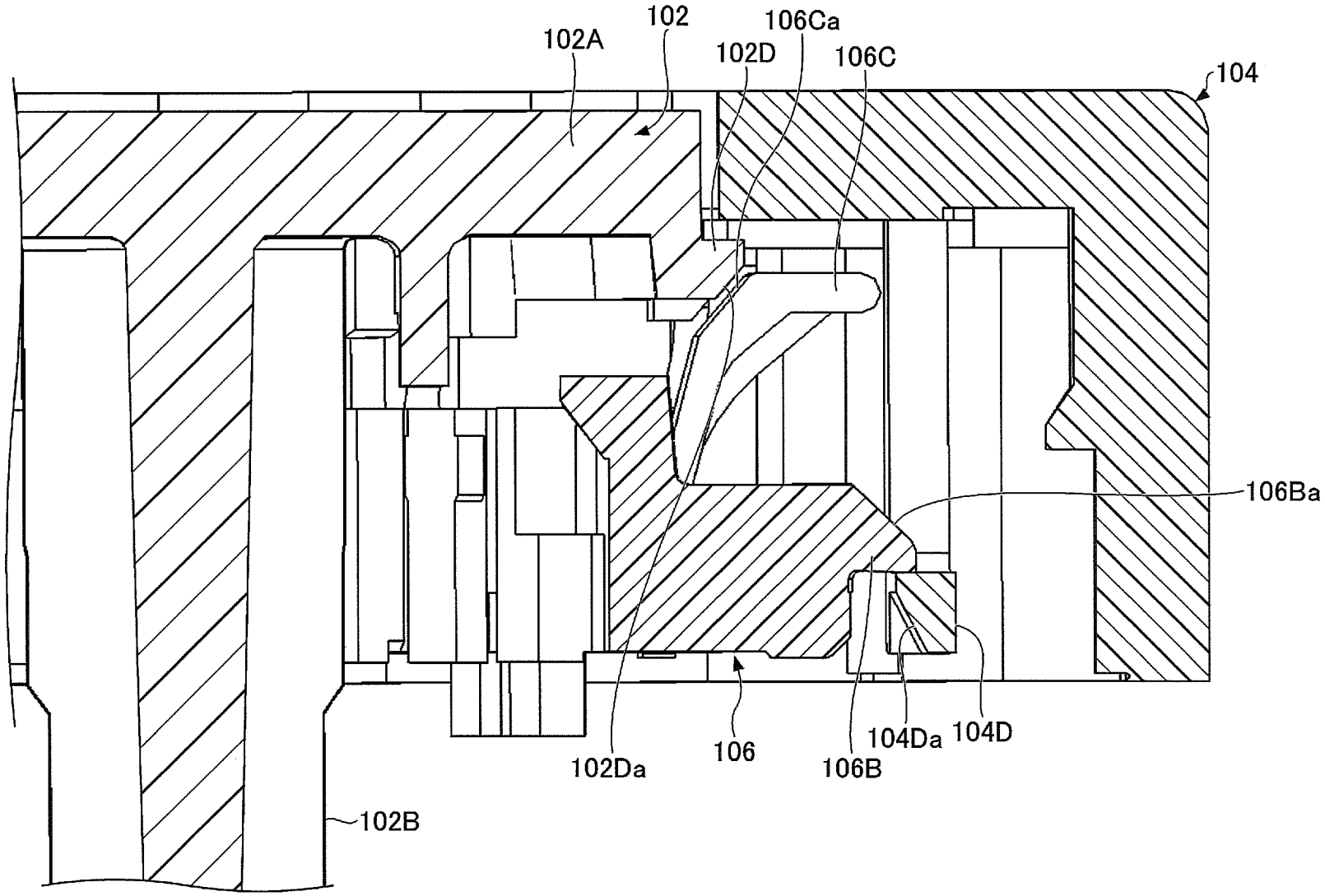
FIG. 7 is a partially enlarged cross-sectional view of the switching device (in a state of no pressing operation being performed) according to the one embodiment.

FIG. 7 is a partially enlarged cross-sectional view of the switching device 100 (in a state of no pressing operation being performed) according to the one embodiment. As illustrated in FIG. 7, when no pressing operation is performed on the knob 102, the hook 104D of the decorative member 104 is engaged with the engaging claw 106B of the first holder 106. In this way, the decorative member 104 is engaged with and held by the first holder 106, so as not to be easily detached upward from the first holder 106. Note that as illustrated in FIG. 7, when no pressing operation is performed on the knob 102, the protruding part 102D of the knob 102 does not press the lever portion 106C of the first holder 106. Therefore, the lever portion 106C remains in an initial state of not being elastically deformed.

Figure 8:
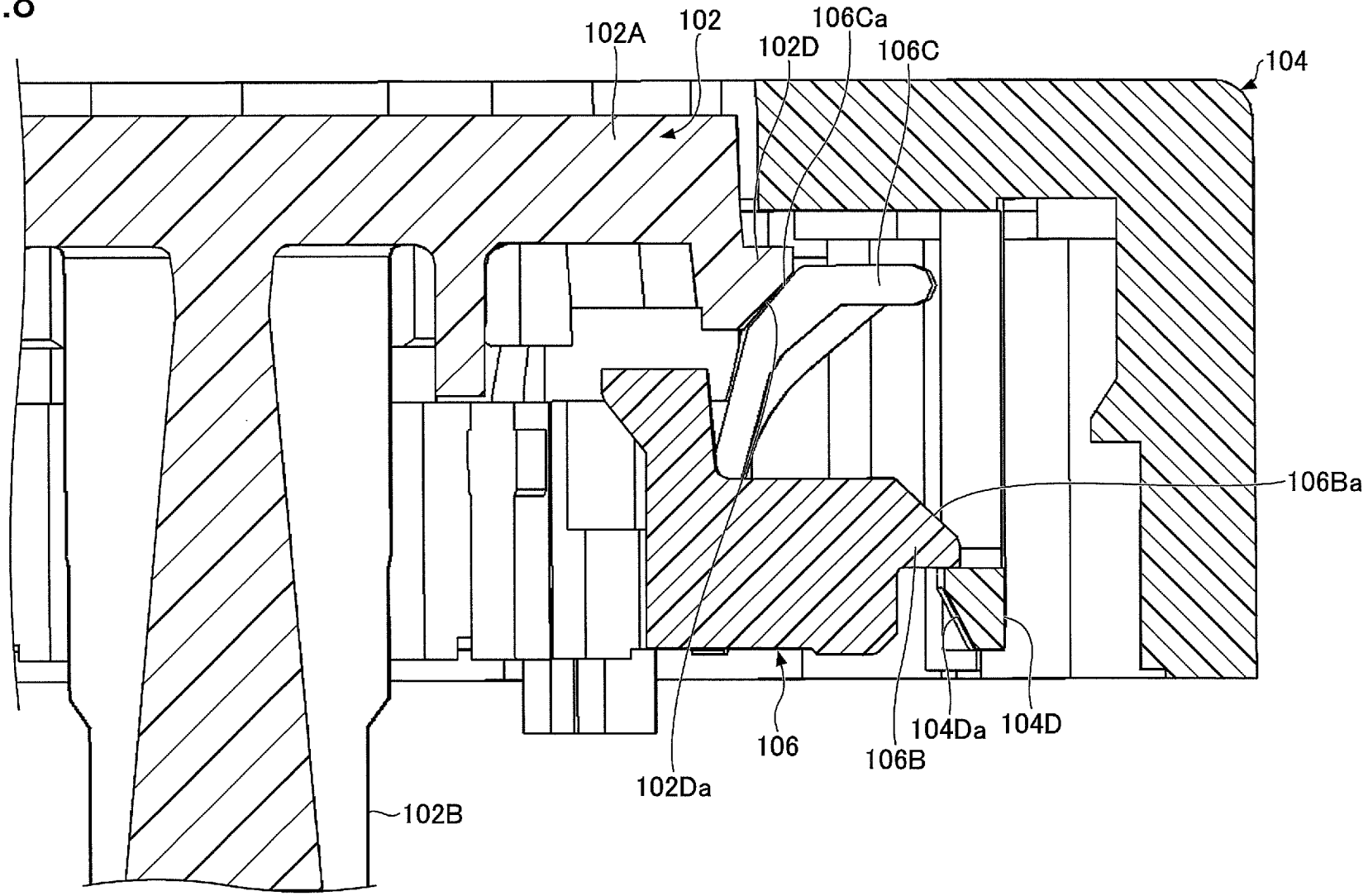
FIG. 8 is a partially enlarged cross-sectional view of the switching device (in a state of a pressing operation of a first stroke amount being performed) according to the one embodiment.

FIG. 8 is a partially enlarged cross-sectional view of the switching device 100 (in a state of a pressing operation of the first stroke amount being performed) according to the one embodiment. When a pressing operation is performed on the knob 102 by the first stroke amount, the actuator 121 is pressed by the protruding part 102C provided at the lower end of the shaft portion 102B of the knob 102 as illustrated in FIG. 4. Also, the pressing detection switch 131 is pressed by the pressed actuator 121. Also, as illustrated in FIG. 8, when a pressing operation is performed on the knob 102 by the first stroke amount, the protruding part 102D of the knob 102 comes into contact with the lever portion 106C of the first holder 106, but does not press the lever portion 106C. Therefore, the lever portion 106C remains in an initial state of not being elastically deformed. Therefore, as illustrated in FIG. 8, the hook 104D of the decorative member 104 remains engaged with the engaging claw 106B of the first holder 106.

Figure 9:
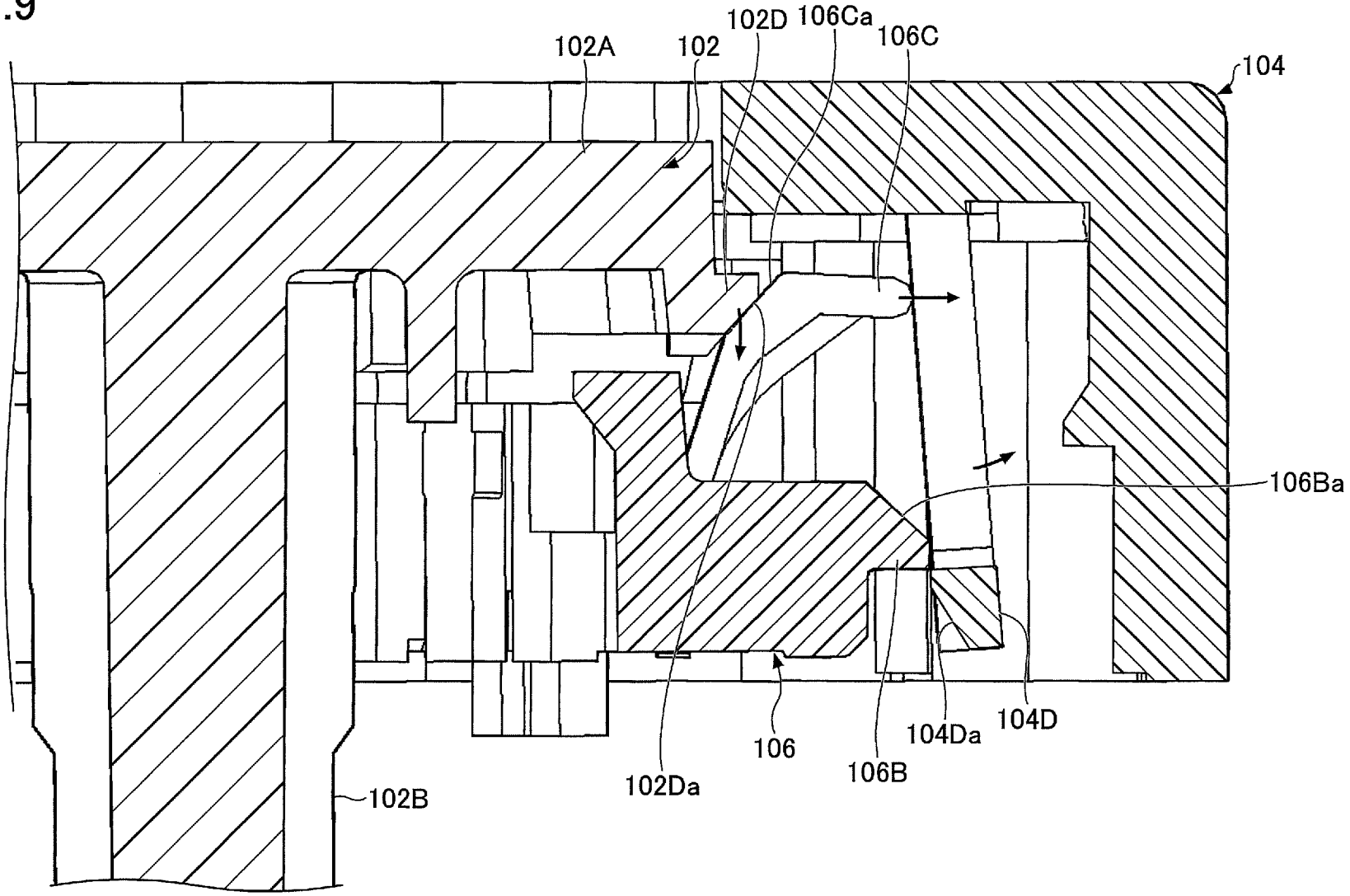
FIG. 9 is a partially enlarged cross-sectional view of the switching device (in a state of a pressing operation of a second stroke amount being performed) according to the one embodiment.

FIG. 9 is a partially enlarged cross-sectional view of the switching device 100 (in a state of a pressing operation of the second stroke amount being performed) according to the one embodiment. As illustrated in FIG. 9, when a pressing operation is performed on the knob 102 by the second stroke amount, the protruding part 102D (the pressing surface 102Da) of the knob 102 presses the lever portion 106C (the pressed surface 106Ca) of the first holder 106. This causes, as illustrated in FIG. 9, the lever portion 106C to elastically deform in a direction extending outward, and causes the tip portion to bias the hook 104D of the decorative member 104 in the outward direction. As a result, as illustrated in FIG. 9, the hook 104D of the decorative member 104 elastically deforms in a direction extending outward, and thereby, the engagement of the hook 104D of the decorative member 104 with the engaging claw 106B of the first holder 106 is released. Therefore, the decorative member 104 can be easily detached from the first holder 106 upward (in the Z-axis positive direction). Note that the decorative member 104 may further have a shape that slides with the first holder 106, separately from the shape (the engaging claw 106B) involving the engagement with the first holder 106. According to such a configuration, the decorative member 104 is hardly detached from the first holder 106 after the operator releases the engagement of the hook 104D with the engaging claw 106B using one finger, until a force to pull out the decorative member 104 upward is applied using the other fingers. Therefore, the decorative member 104 is less likely to be disengaged against the intent of the operator.

In this way, by performing a pressing operation on the knob 102 by the first stroke amount, the switching device 100 according to the one embodiment can press the pressing detection switch 131; and by performing a pressing operation on the knob 102 by the second stroke amount, without using a tool or the like, the engaged state of the decorative member 104 and the first holder 106 can be released. Therefore, in the switching device 100 according to the one embodiment, the decorative member 104 can be easily removed, while preventing damage and deformation of the engaged/engaging portions of the decorative member 104 (the hook 104D and the engaging claw 106B).

Note that when a pressing operation is performed by the second stroke amount, the pressing detection switch 131 is pushed further downward from the switch-on state by a greater stroke amount. However, by elastic deformation of the rubber stem 131A included in the pressing detection switch 131 (examples of an "elastic defamation part" and an "elastically deformable pressor"), the load acting on the pressing detection switch 131 is buffered. In other words, damage of the contact of the pressing detection switch 131 can be suppressed.

Also, the disengagement operations in FIGS. 7 to 9 are performed simultaneously at the four engaged/engaging portions in the switching device 100 (the hook 104D and the engaging claw 106B). In other words, by performing a pressing operation on the knob 102 by the second stroke amount, the switching device 100 according to the one embodiment can simultaneously release the engagement at each of the four engaged/engaging portions (the hook 104D and the engaging claw 106B).

Also, as illustrated in FIGS. 7 to 9, the lower end of the hook 104D is provided with an inclined surface 104Da inclined downward and inward, and the tip of the engaging claw 106B is provided with an inclined surface 106Ba inclined upward and outward. Therefore, when attaching the decorative member 104 to the switching device 100 according to the one embodiment, by simply pushing the decorative member 104 downward, the inclined surface 104Da comes into contact with the inclined surface 106Ba, and thereby, the hook 104D is pushed to be spread outward, and thereby, the hook 104D can be engaged with the engaging claw 106B.

(Configuration and Operations of Rotating Mechanism)

Figure 10:
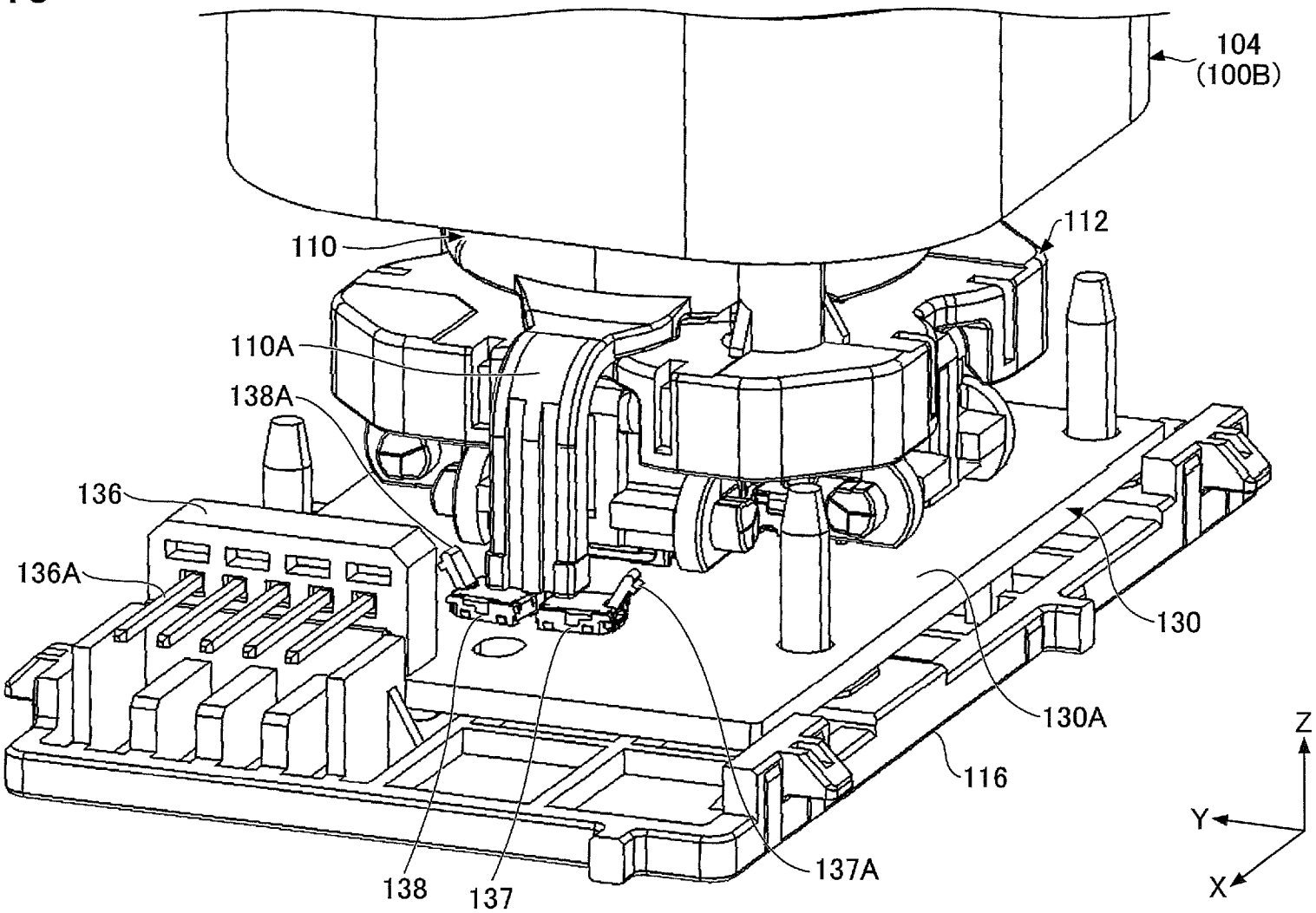
FIG. 10 is a diagram illustrating a state of a rotating mechanism when a rotating operation is not performed on the switching device according to the one embodiment.

FIG. 10 is a diagram illustrating a state of a rotating mechanism when a rotating operation is not performed on the switching device 100 according to the one embodiment. FIG. 11 is a diagram illustrating a state of the rotating mechanism when a rotating operation of the switching device 100 is performed according to the one embodiment. Note that in FIGS. 10 and 11, illustration of the case 108 and the subcase 114 is omitted. Also, the "rotating mechanism" is constituted with a second holder 110 and two rotation detection switches 137 and 138. Each of the rotation detection switches 137 and 138 has a metallic spring member built in, to provide a returning force.

Figure 11:
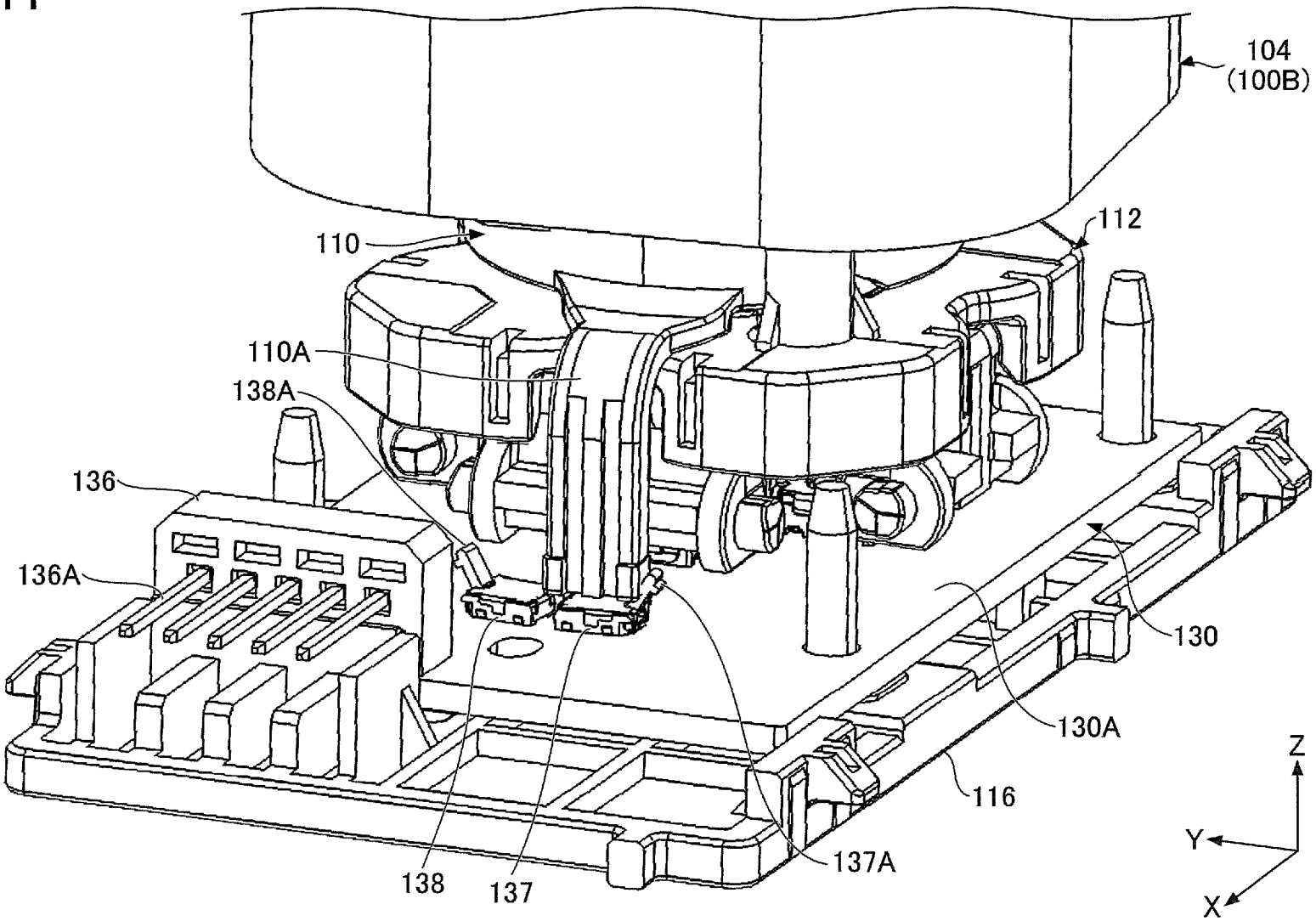
FIG. 11 is a diagram illustrating a state of a rotating mechanism when a rotating operation of the switching device is performed according to the one embodiment.

As illustrated in FIGS. 10 and 11, in the interior of the case 108, the second holder 110 having roughly a cylindrical shape is provided. The second holder 110 is rotatably supported by a cylindrical portion 112A of the slider 112. The second holder 110 is an example of a "rotating member". Also, the second holder 110 is engaged with the first holder 106 of the operation part 100B so as not to rotate against each other. In this way, when a rotating operation is performed on the operation part 100B, the second holder 110 rotates around the central axis AX together with the operation part 100B.

Also, as illustrated in FIGS. 10 and 11, the second holder 110 includes an arm 110A that extends from a side face on the front side (the X-axis positive side) toward the lower side (in the Z-axis negative direction). The arm 110A is integrally formed with the second holder 110, and thereby, rotates around the central axis AX together with the second holder 110.

As illustrated in FIG. 10, when a rotating operation is not being performed on the operation part 100B, the lower end of the arm 110A is positioned above an intermediate position between the two rotation detection switches 137 and 138 mounted on the top surface 130A of the substrate 130. The rotation detection switches 137 and 138 are provided with the lever 137A and 138A, respectively, each of which is rotatable between a standing state and a tilted state, when part of the lever elastically deforms. As illustrated in FIG. 10, when a rotating operation is not being performed on the operation part 100B, the lever 137A and 138A are in the standing state. This causes the rotation detection switches 137 and 138 to be in an off state.

Then, when a rotating operation is performed on the operation part 100B, the second holder 110 and the arm 110A rotate together with the operation part 100B. Accordingly, the arm 110A tilts the lever 137A of the rotation detection switch 137 in the direction of rotation, or tilts the lever 138A of the rotation detection switch 138. This makes the rotation detection switch 137 or the rotation detection switch 138 transition to an on state, and a rotational operation signal corresponding to the direction of rotation of the operation part 100B is output to the outside via the connector 136.

For example, FIG. 11 illustrates a state in which a rotating operation is performed on the operation part 100B in the counterclockwise direction. In this case, the arm 110A of the second holder 110 tilts the lever 137A of the rotation detection switch 137 present in the counterclockwise direction. This causes the rotation detection switch 137 to transition to an on state, and a rotational operation signal corresponding to the rotating operation in the counterclockwise direction of the operation part 100B is output to the outside via the connector 136.

On the other hand, in the case where a rotating operation is performed on the operation part 100B in the clockwise direction, the arm 110A of the second holder 110 tilts the lever 138A of the rotation detection switch 138 present in the clockwise direction. This causes the rotation detection switch 138 to transition to an on state, and a rotational operation signal corresponding to the rotating operation in the clockwise direction of the operation part 100B is output to the outside via the connector 136.

In this way, according to the one embodiment, the switching device 100 includes the second holder 110 that is rotatably supported by the slider 112, to rotate by an operating force from the operation part 100B; and the rotation detection switch 138 to execute a switching operation in response to the rotation of the second holder 110. Therefore, on the switching device 100 according to the one embodiment, in addition to a sliding operation on the operation part 100B, a rotating operation on the operation part 100B can be performed, and a rotating operation can be detected by the rotation detection switch 138. When the rotating operation is released, the members involved in the rotating operation return to the respective initial positions by the returning force of the rotation detection switch 137 or the rotation detection switch 138.

(Rotation Returning Mechanism)

Figure 12:
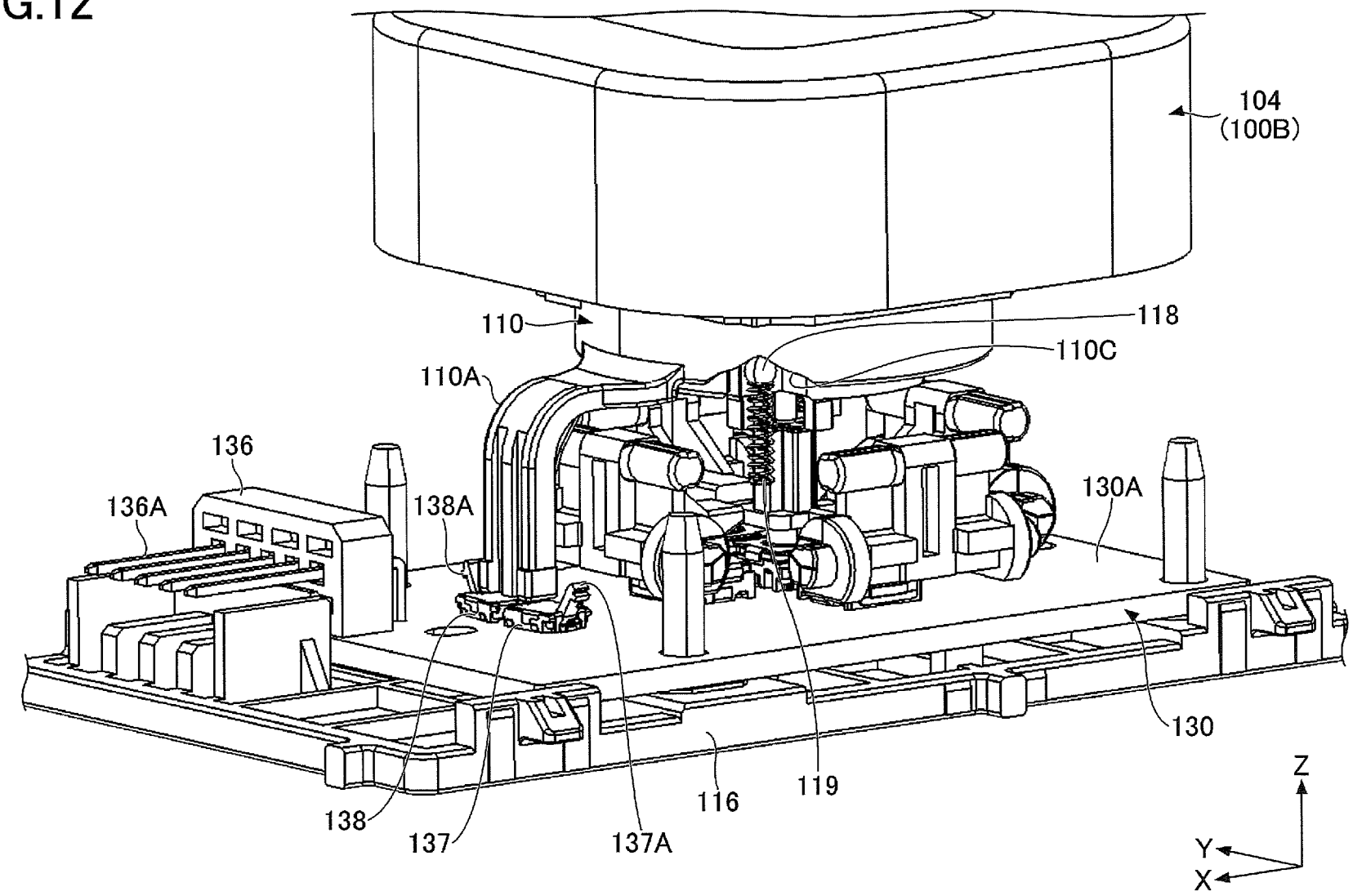
FIG. 12 is a diagram illustrating a state of a rotation returning mechanism when a rotating operation is not performed on the switching device according to the one embodiment.

FIG. 12 is a diagram illustrating a state of a rotation returning mechanism when a rotating operation is not performed on the switching device 100 according to the one embodiment. Note that in FIG. 12, illustration of the case 108, the subcase 114, and the slider 112 is omitted. Also, the "rotation returning mechanism" is constituted with a cam surface 110C of the second holder 110, a ball 118, and a coil spring 119.

As illustrated in FIG. 12, the second holder 110 has the cam surface 110C formed to have an upward (in the Z-axis positive direction) mountain shape. On the cam surface 110C, the ball 118 being held by the slider 112 is pressed on the lower side (the Z-axis negative side) by a biasing force of the coil spring 119 being held by the slider 112.

As illustrated in FIG. 12, when no rotating operation is performed on the operation part 100B, the ball 118 biases the top of the cam surface 110C. In this way, the second holder 110 can stably maintain a state of the initial position when no rotating operation is performed.

On the other hand, once a rotating operation is performed on the operation part 100B, as the second holder 110 rotates, the ball 118 slides on the inclined surface of the cam surface 110C toward the tail of the cam surface 110C while pressing and contracting the coil spring 119 by the biasing force from the cam surface 110C.

Then, once the rotating operation on the operation part 100B is released, the ball 118 slides on the inclined surface of the cam surface 110C toward the top of the cam surface 110C, while the biasing force from the coil spring 119 biases the inclined surface of the cam surface 110C. At this time, by the biasing force from the ball 118, the second holder 110 rotates in a direction opposite to the direction of rotation upon the rotating operation, and returns to the initial position when no rotating operation is performed.

Note that the second holder 110 includes two cam surfaces 110C that are arranged at 180-degree intervals. Accordingly, the switching device 100 holds two pairs of ball 118 and coil spring 119. In this way, the switching device 100 can stably bias the two cam surfaces 110C of the second holder 110 on the lower side (the Z-axis negative side) by the two balls 118.

(Configuration of the Slide Mechanism)

Next, with reference to FIGS. 13 to 20, a configuration of the slide mechanism included in the switching device 100 according to the one embodiment will be described. The "slide mechanism" is constituted with the slider 112, the subcase 114, actuators 122-1 to 122-4, and slide detection switches 132-1 to 132-4. Note that in the present embodiment, although a tact switch having a metal dome contact and a rubber stem is used as a slide detection switch, the slide detection switch simply needs to be provided with a contact point and a returning force, and not limited to the tact switch.

<Configuration of the Substrate 130>

Figure 13:
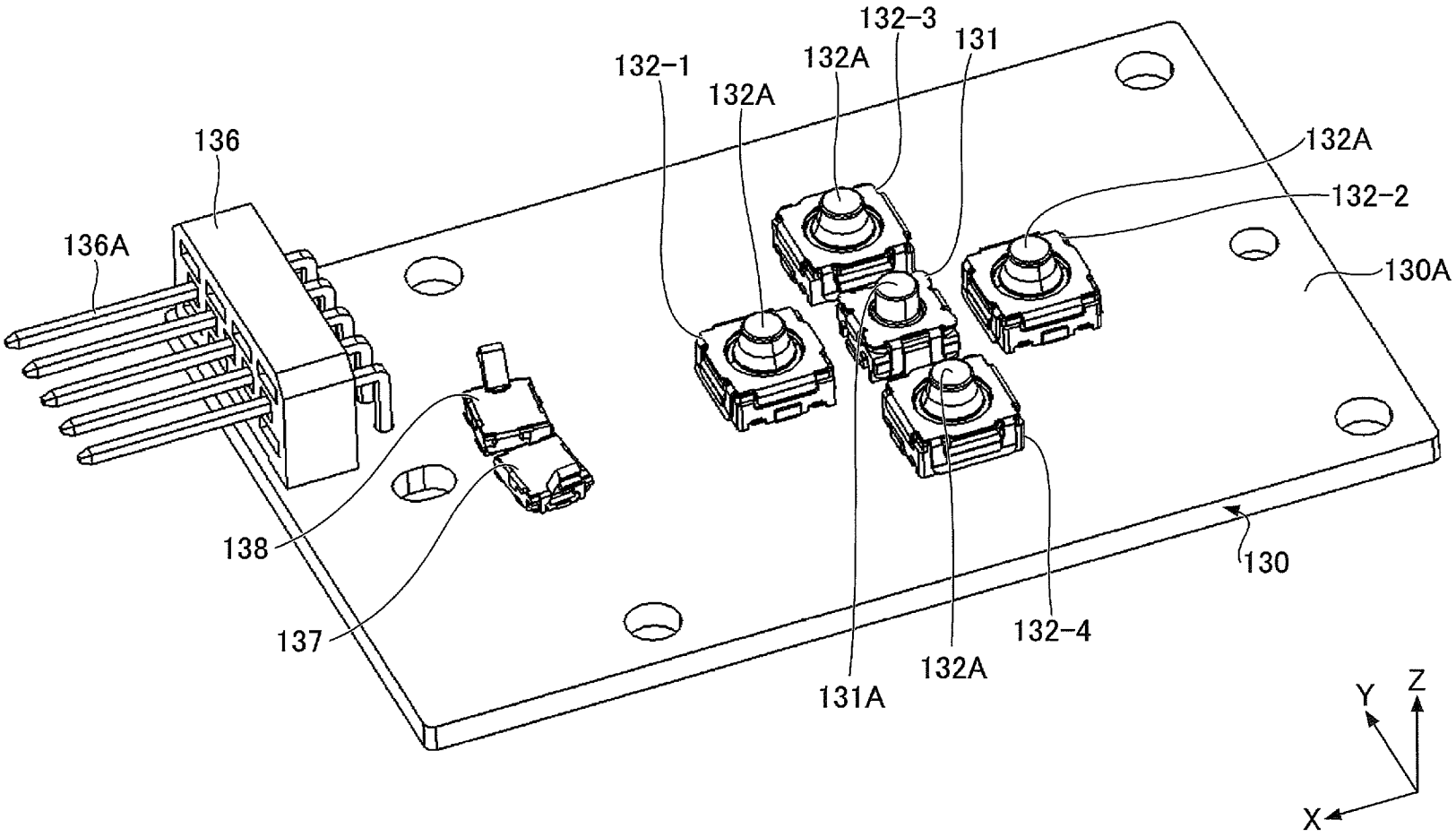
FIG. 13 is an external perspective view of a substrate provided in the switching device according to the one embodiment.

FIG. 13 is an external perspective view of the substrate 130 provided in the switching device 100 according to the one embodiment.

The substrate 130 is a hard, flat plate-shaped member made of resin. The substrate 130 has a substantially rectangular shape in plan view. In the case 108, the substrate 130 is fixed on the top surface of the cover 116 in a horizontal position with respect to the XY-plane. As the substrate 130, for example, a printed wiring board (PWB) may be used.

As illustrated in FIG. 13, a pressing detection switch 131 and the slide detection switches 132-1 to 132-4 are mounted on the top surface 130A of the substrate 130. The pressing detection switch 131 is arranged at the center of the top surface 130A (on the central axis AX) of the substrate 130. The pressing detection switch 131 is provided with a rubber stem 131A protruding upward (in the Z-axis positive direction). In response to the top surface of the rubber stem 131A being pressed, the pressing detection switch 131 is switched to a switch-on state.

The slide detection switch 132-1 is arranged on the front side (the X-axis positive side) relative to the pressing detection switch 131. The slide detection switch 132-2 is arranged on the rear side (the X-axis negative side) relative to the pressing detection switch 131. The slide detection switch 132-3 is arranged on the right side (the Y-axis positive side) relative to the pressing detection switch 131. The slide detection switch 132-4 is arranged on the left side (the Y-axis negative side) relative to the pressing detection switch 131. Each of the slide detection switches 132-1 to 132-4 is provided with an elastically deformable rubber stem 132A protruding upward (in the Z-axis positive direction). Each of the slide detection switches 132-1 to 132-4 is switched to a switch-on state, in response to the top surface of the rubber stem 132A being pressed.

The connector 136 is provided on the top surface 130A of the substrate 130. The connector 136 includes multiple connector pins 136A, arranged side by side in the left-and-right direction (the Y-axis direction). Each of the connector pins 136A is a member formed of metal and having a stick shape. The switching device 100 is electrically connected to the outside by having an external connector (not illustrated) connected to the connector 136, and thereby, operation signals of the respective switch 131 and 132 can be supplied to the outside.

<Configuration of the Actuator Unit 120>

Figure 14:
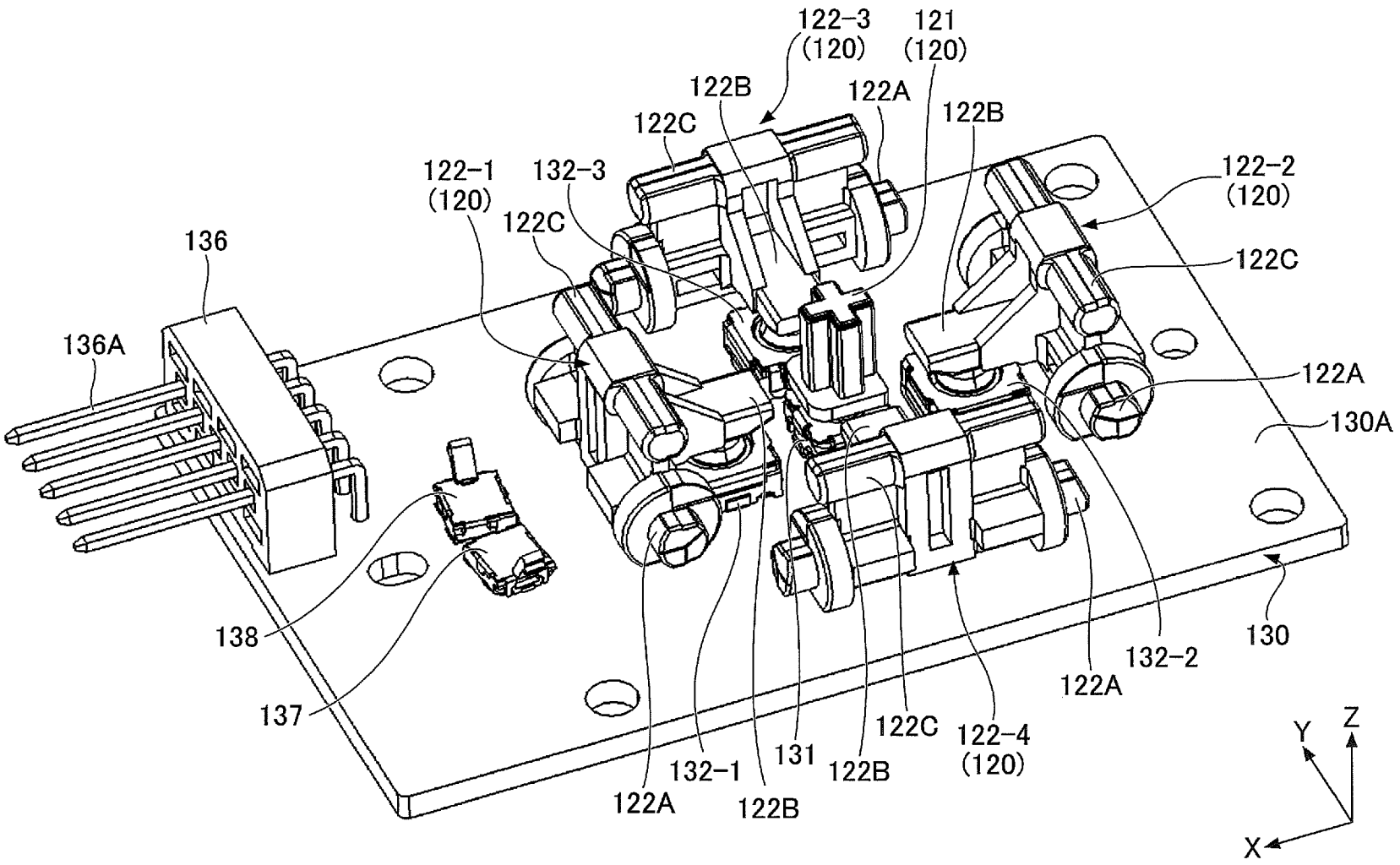
FIG. 14 is an external perspective view of the substrate and an actuator unit provided in the switching device according to the one embodiment.

FIG. 14 is an external perspective view of the substrate 130 and the actuator unit 120 provided in the switching device 100 according to the one embodiment. As illustrated in FIG. 14, the actuator unit 120 includes the actuator 121 and the actuators 122-1 to 122-4. The actuators 122-1 to 122-4 are examples of a "drive member".

The actuator 121 is arranged above the pressing detection switch 131, to be movable in the up-and-down direction (the Z-axis direction).

The actuator 122-1 is arranged above the slide detection switch 132-1, to be rotatable around the central axis arranged in the Y-axis direction. The top surface of the rubber stem 132A included in the slide detection switch 132-1 contacts the lower surface of the arm portion 122B included in the actuator 122-1.

The actuator 122-2 is arranged above the slide detection switch 132-2, to be rotatable around the central axis arranged in the Y-axis direction. The top surface of the rubber stem 132A included in the slide detection switch 132-2 contacts the lower surface of an arm portion 122B included in the actuator 122-2.

The actuator 122-3 is arranged above the slide detection switch 132-3, to be rotatable around the central axis arranged in the X-axis direction. The top surface of the rubber stem 132A included in the slide detection switch 132-3 contacts the lower surface of an arm portion 122B included in the actuator 122-3.

The actuator 122-4 is arranged above the slide detection switch 132-4, to be rotatable around the central axis arranged in the X-axis direction. The top surface of the rubber stem 132A included in the slide detection switch 132-4 contacts the lower surface of an arm portion 122B included in the actuator 122-4.

Each of the actuators 122-1 to 122-4 is arranged to be rotatable by having a rotating shaft portion 122A fitted and supported in a bearing hole 114E of the subcase 114 as will be described in detail later. Also, each of the actuators 122-1 to 122-4 includes the arm portion 122B that extends from the center of the rotating shaft portion 122A toward the central axis AX. The lower surface of the arm portion 122B contacts the top surface of the rubber stem 132A included in the slide detection switch 132. Also, each of the actuators 122-1 to 122-4 includes a bar-shaped lever portion 122C above the rotating shaft portion 122A, extending in the same direction as the rotating shaft portion 122A.

When no sliding operation is performed, the arm portion 122B of each of the actuators 122-1 to 122-4 maintains a horizontal state by being supported on the lower side by the rubber stem 132A of the slide detection switch 132.

<Configuration of the Slider 112>

Figure 15:
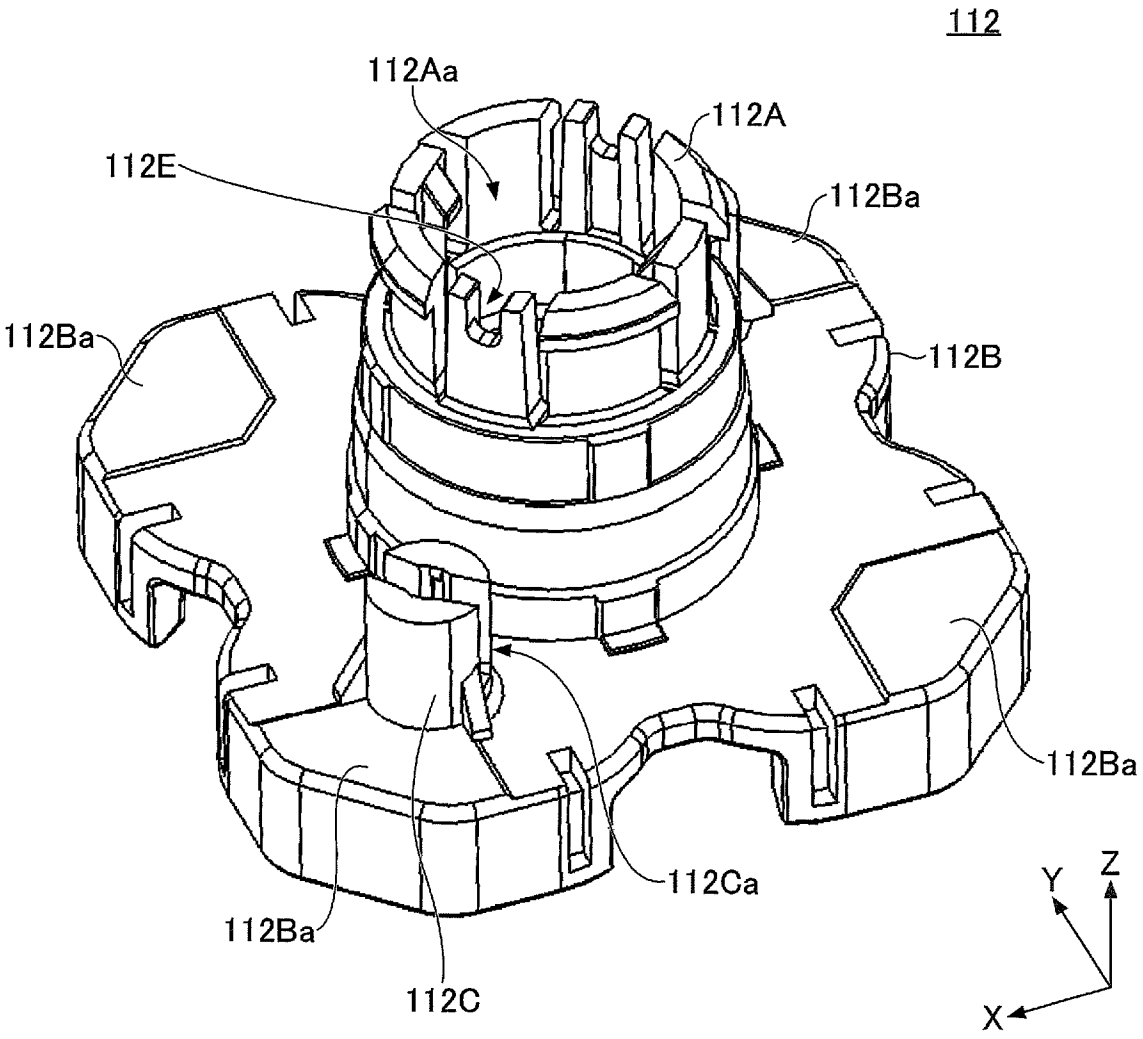
FIG. 15 is an external perspective view of a slider provided in the switching device according to the one embodiment.

FIG. 15 is an external perspective view of the slider 112 provided in the switching device 100 according to the one embodiment. The slider 112 illustrated in FIG. 15 is an example of a "slide member" that slides by the operating force from the operation part 100B. As illustrated in FIG. 15, the slider 112 includes a cylindrical portion 112A and a sliding portion 112B. The slider 112 is an example of a "slide member".

The cylindrical portion 112A is a portion provided at the center of the slider 112 (on the central axis AX), having a cylindrical shape extending along the central axis AX in the up-and-down direction (the Z-axis direction). Upon being inserted into the opening portion 110B of the second holder 110 (see FIG. 21), the cylindrical portion 112A rotatably supports the second holder 110. Also, upon the shaft portion 102B of the knob 102 being inserted into the cylinder inside 112Aa, the cylindrical portion 112A supports the knob 102 to be movable in the up-and-down direction (the Z-axis direction), and makes the slider 112 slidable together with the operation part 100B.

The sliding portion 112B is a portion having a constant thickness, extending outward in the horizontal direction from the lower end of the outer periphery of the cylindrical portion 112A. The sliding portion 112B has a substantially rectangular shape in plan view. As the slider 112 slides, the sliding portion 112B slides on a sliding surface 114B (see FIG. 16) of the subcase 114 in a recess 114A (see FIG. 16) of the subcase 114.

Also, by having each of the four corners 112Ba arranged in a state of entering a corresponding one of four slit portions 114C (see FIG. 16) of the subcase 114, the sliding portion 112B makes the slider 112 slidable in the horizontal directions (the X-axis direction and the Y-axis direction), and restricts movement and a wobble of the slider 112 in the up-and-down direction (the Z-axis direction).

Also, as illustrated in FIG. 15, the slider 112 includes a holding part 112C having a circular column shape. The holding part 112C is provided to protrude upward (in the Z-axis positive direction) from a position close to a corner (a position that overlaps the cam surface 110C of the second holder 110 in plan view) on the top surface of the sliding portion 112B. The holding part 112C has a cut-off portion 112Ca that is cut off along the circumferential direction, and within the cut-off portion 112Ca, the cam surface 110C of the second holder 110 moves in the circumferential direction as the second holder 110 rotates. Also, the holding part 112C holds the ball 118 to be movable in the up-and-down direction, and holds the coil spring 119 arranged on the lower side of the ball 118 to be extendable and contractible in the up-and-down direction (the Z-axis direction). This enables the switching device 100 to bias the cam surface 110C of the second holder 110 from the lower side (the Z-axis negative side) by the ball 118. Note that the slider 112 includes two holding parts 112C that are arranged at 180-degree intervals. The slider 112 can hold two pairs of ball 118 and coil spring 119.

<Configuration of the Subcase 114>

Figure 16:
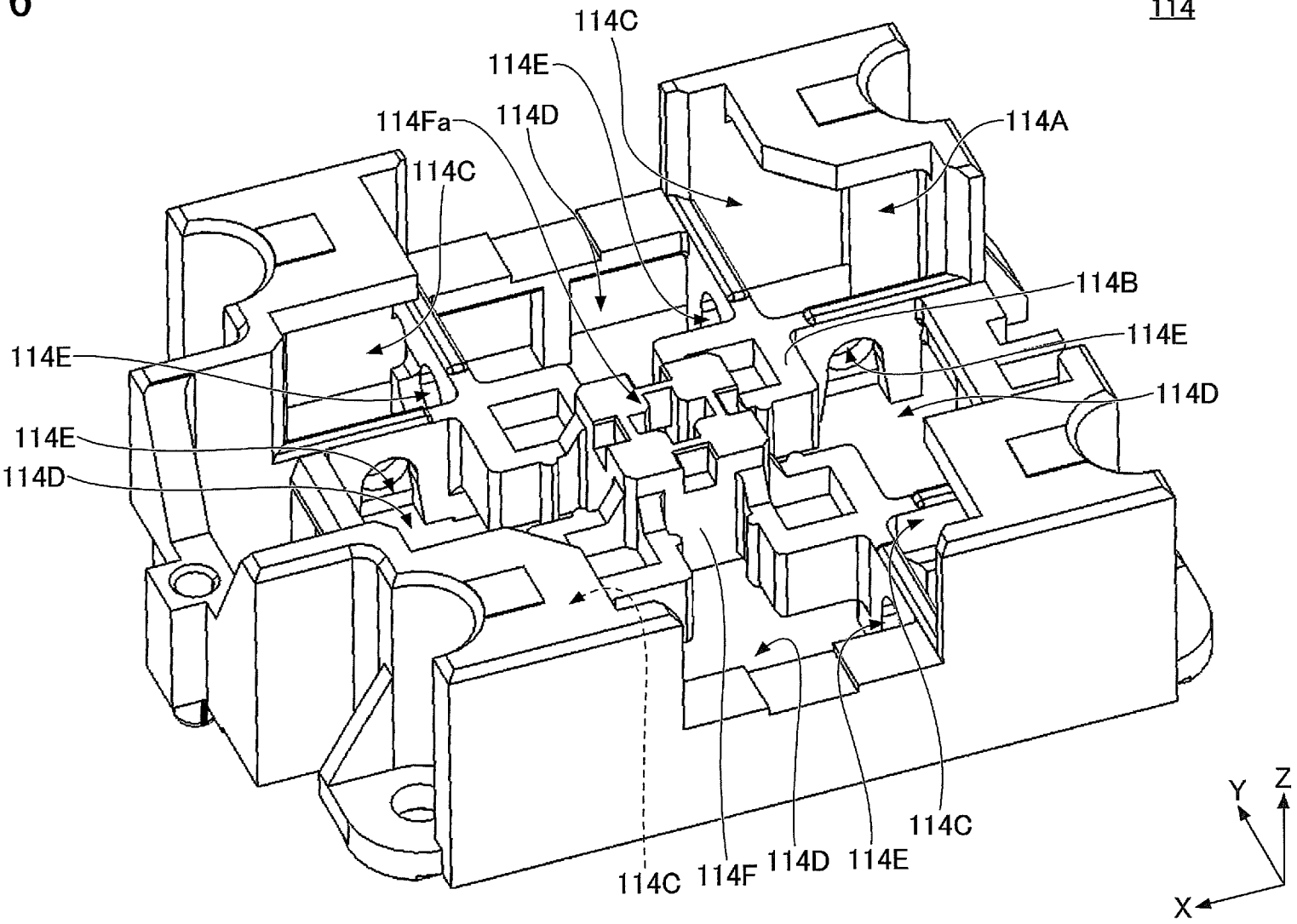
FIG. 16 is an external perspective view of a subcase provided in the switching device according to the one embodiment.

FIG. 16 is an external perspective view of the subcase 114 provided in the switching device 100 according to the one embodiment. The subcase 114 illustrated in FIG. 16 is an example of a "support member", and is a block-shaped (a shape of roughly a rectangular parallelepiped) member that slidably supports the slider 112. The subcase 114 is an example of a "support member".

As illustrated in FIG. 16, the subcase 114 includes the recess 114A that is recessed downward (in the Z-axis negative direction) from the top surface of the subcase 114. The recess 114A has a cross shape that includes part extending in the forward-and-backward direction (the X-axis direction) and part extending in the left-and-right direction (the Y-axis direction). The recess 114A is a space in which the slider 112 is slidably housed. The inner bottom surface of the recess 114A corresponds to a horizontal sliding surface 114B on which the slider 112 slides.

Also, the subcase 114 has the four slit portions 114C at the four inner corners of the recess 114A, respectively. Each of the four slit portions 114C is a portion into which the corresponding one of the four corners 112Ba of the slider 112 is inserted. Each of the four slit portions 114C allows the corresponding one of the four corners 112Ba of the slider 112 to be slidable on the outside relative to the recess 114A, and restricts the movement of the corresponding one of the four corners 112Ba in the up-and-down direction (the Z-axis direction).

Also, the subcase 114 has four housings 114D on the lower side of the four tips of the recess 114A, respectively. Each of the four housings 114D contains the corresponding one of the four actuators 122-1 to 122-4. Each of the four housings 114D is provided with a pair of bearing holes 114E. The pair of bearing holes 114E rotatably bears the actuator 122 by having both ends of the rotating shaft portion 122A of the actuator 122 fitted in the holes.

Also, the subcase 114 includes a supporting part 114F at the central portion (on the central axis AX), having a shape of a rectangular cylinder. The supporting part 114F supports the top portion of the actuator 121 to be moveable in the up-and-down direction (the Z-axis direction) in the cylinder. An opening portion 114Fa having a cross shape is formed on the top surface of the supporting part 114F. By exposing the top surface of the actuator 121 through the opening portion 114Fa, the protruding part 102C of the knob 102 can press the top surface of the actuator 121.

Figure 17:
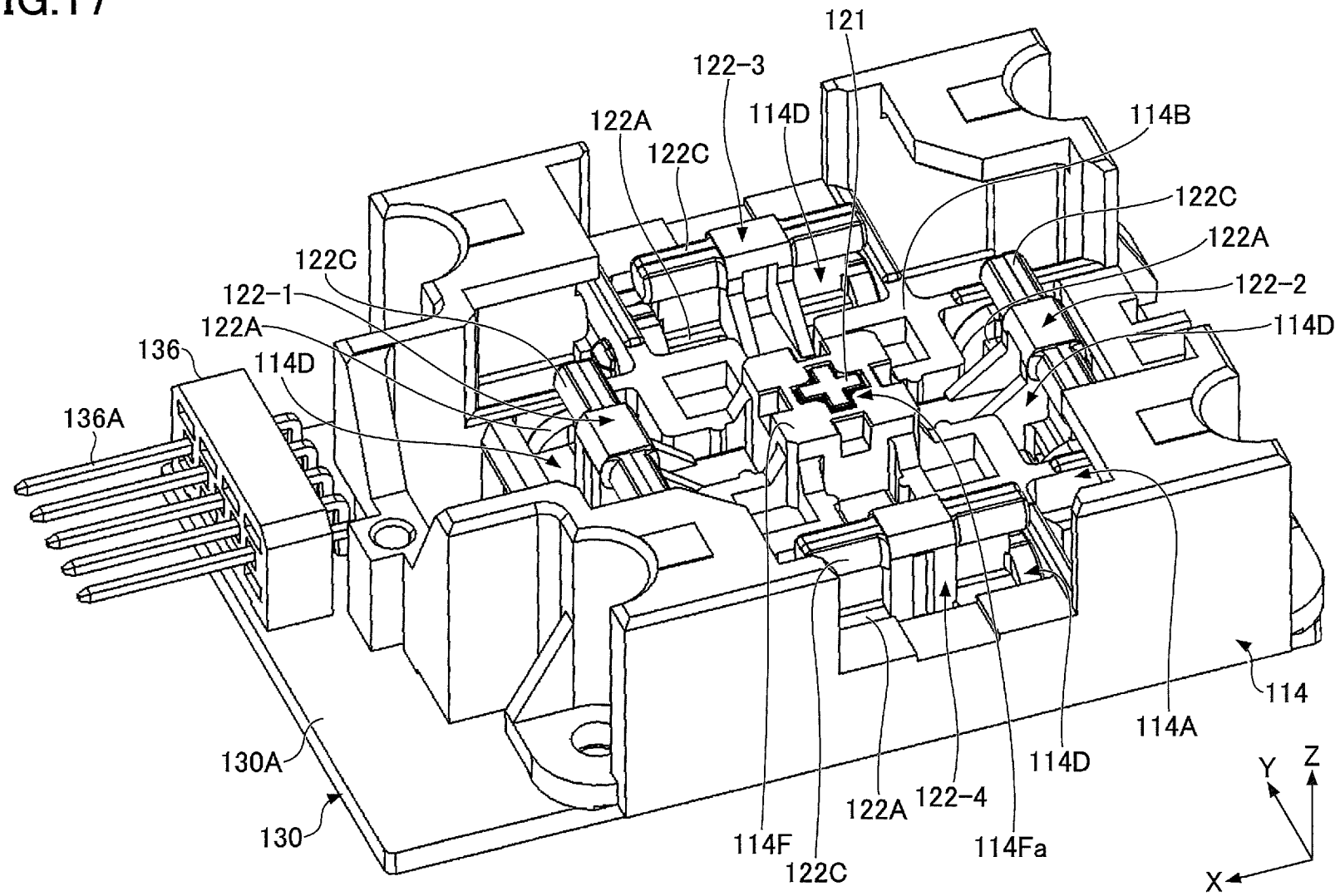
FIG. 17 is a diagram illustrating a state in which an actuator is built in a subcase arranged on the top surface of the substrate.

FIG. 17 is a diagram illustrating a state in which the actuators 121 and 122 are built in the subcase 114 arranged on the top surface 130A of the substrate 130.

As illustrated in FIG. 17, each of the four housings 114D included in the subcase 114 contains the corresponding one of the four actuators 122-1 to 122-4. Each of the actuators 122 has both ends of the rotating shaft portion 122A rotatably supported by the pair of bearing holes 114E (see FIG. 16) provided on the inner wall surfaces of the housing 114D. In this way, each of the actuators 122 is rotatably supported in the housing 114D.

Also, as illustrated in FIG. 17, the lever portion 122C of each of the actuators 122 is arranged above the sliding surface 114B of the subcase 114. Therefore, the lever portion 122C of each of the actuators 122 can be operated by the slider 112 sliding in the recess 114A of the subcase 114.

Also, as illustrated in FIG. 17, the top portion of the actuator 121 is supported in the cylinder of the supporting part 114F provided at the central portion of the subcase 114 (on the central axis AX). The top surface of the actuator 121 is exposed from the opening portion 114Fa formed on the top surface of the supporting part 114F. Therefore, the actuator 121 can be pressed by the protruding part 102C of the knob 102.

Figure 18:
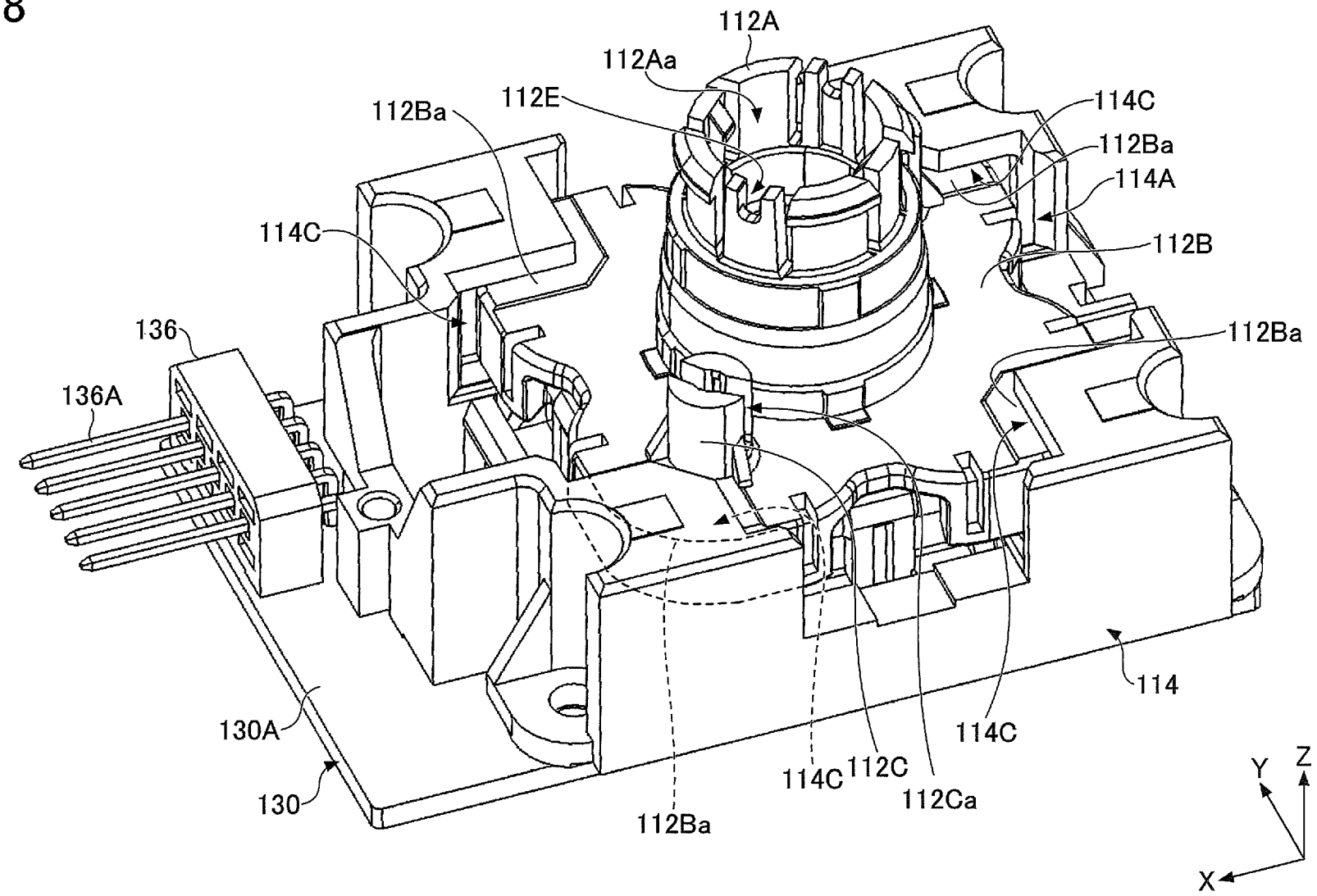
FIG. 18 is a diagram illustrating a state in which a slider is further built in the subcase illustrated in FIG. 17.

FIG. 18 is a diagram illustrating a state in which the slider 112 is further built in the subcase 114 illustrated in FIG. 17.

As illustrated in FIG. 18, the slider 112 is arranged in the recess 114A of the subcase 114. In the recess 114A or the like, the subcase 114 can slide on the sliding surface 114B (i.e., the inner bottom surface of the recess 114A) of the subcase 114 in the horizontal directions (the X-axis direction and the Y-axis direction).

Also, as illustrated in FIG. 18, each of the four corners 112Ba of the slider 112 is arranged on the outside relative to the recess 114A, in a state of being inserted into the corresponding one of the four slit portions 114C of the subcase 114. Therefore, in the recess 114A or the like, the slider 112 can slide in the horizontal directions (the X-axis direction and the Y-axis direction), and each of the four slit portions 114C restricts movement and a wobble in the up-and-down direction (the Z-axis direction).

<Configuration of the Slider 112 to Hold the Actuator 122>

Figure 19:
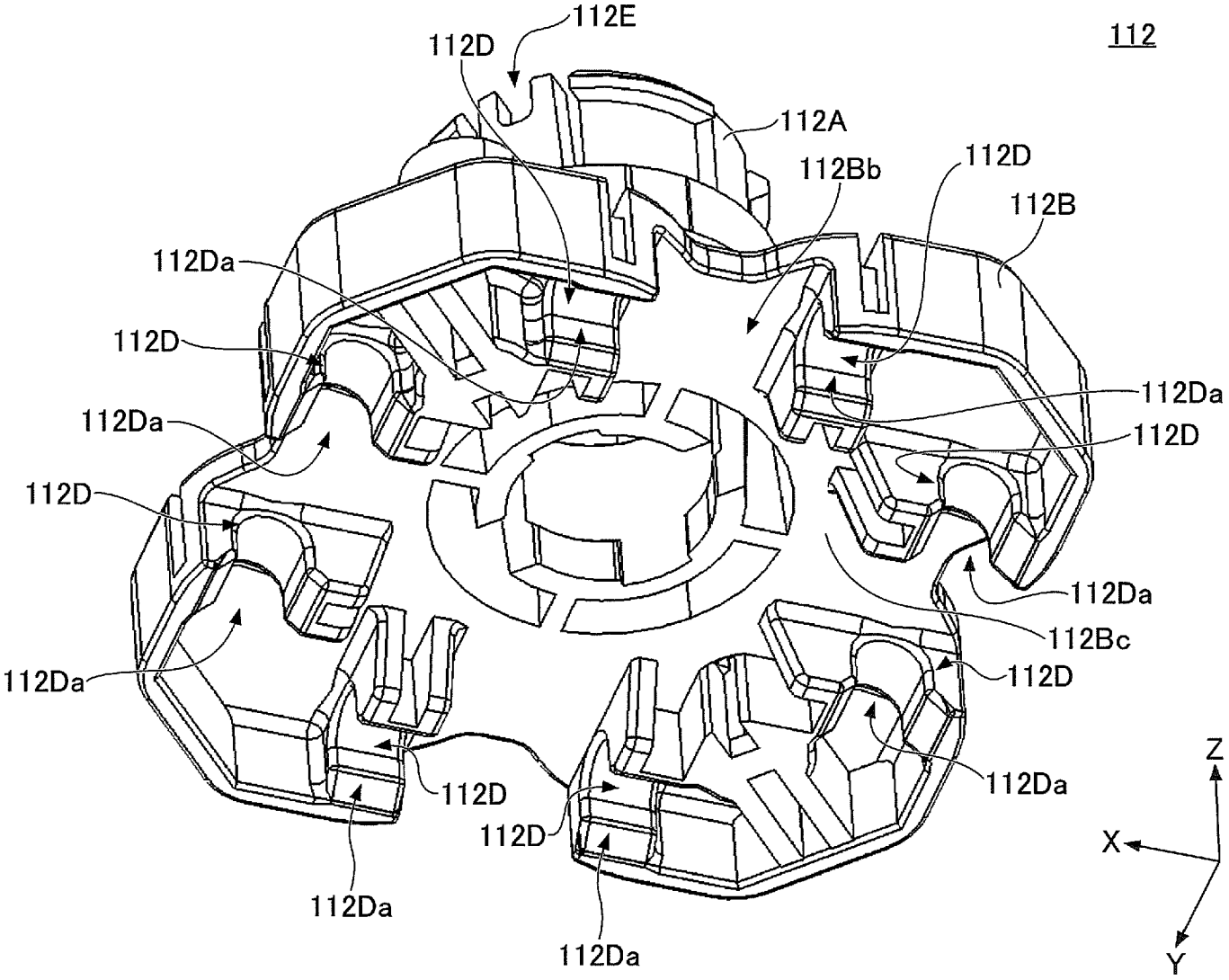
FIG. 19 is an external perspective view of the slider provided in the switching device as viewed on the lower side according to the one embodiment.
Figure 20:
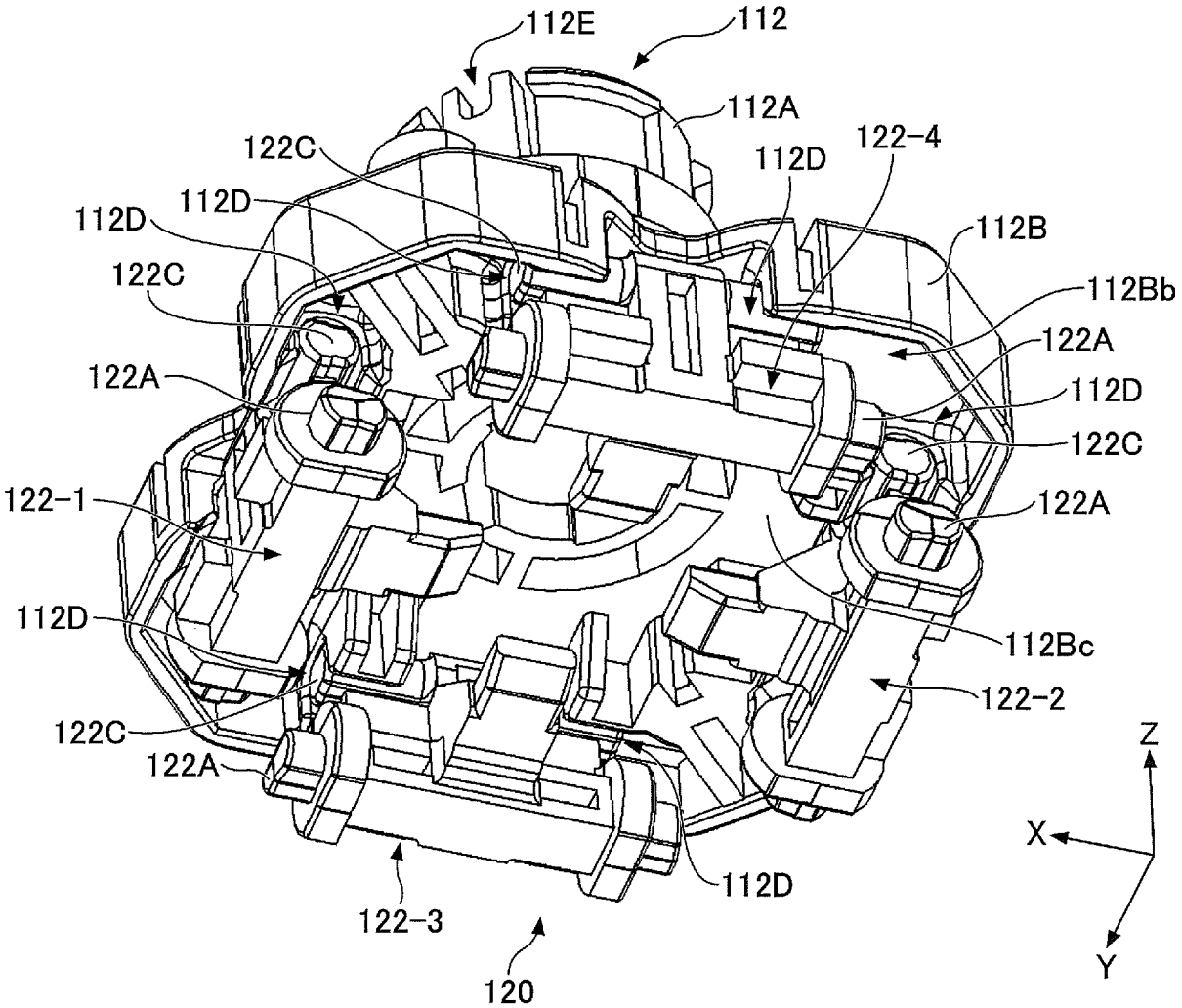
FIG. 20 is an external perspective view of the slider provided in the switching device (in a state of an actuator being held) as viewed on the lower side according to the one embodiment.

FIG. 19 is an external perspective view of the slider 112 provided in the switching device 100 as viewed on the lower side according to the one embodiment. FIG. 20 is an external perspective view of the slider 112 (in a state of the actuators 122-1 to 122-4 being held) provided in the switching device 100 as viewed on the lower side according to the one embodiment.

As illustrated in FIG. 19, the slider 112 includes a pair of holder parts 112D in an internal space 112Bb of the sliding portion 112B having an opening on the lower side (the Z-axis negative side), in each of the four sliding directions (the X-axis direction and the Y-axis direction). The slider 112 can hold the lever portion 122C of each of the actuators 122 by the corresponding pair of holder parts 112D.

As illustrated in FIG. 19, each of the holder parts 112D is provided to be hanging down from the ceiling surface 112Bc of the internal space 112Bb. Each of the holder parts 112D has an opening portion 112Da on the lower side (the Z-axis negative side), and through the opening portion 112Da, the lever portion 122C of the actuator 122 can be inserted to be fitted.

As illustrated in FIG. 20, each of the four actuators 122-1 to 122-4 is arranged on the lower side of the corresponding pair of the holder parts 112D included in the slider 112. Also, as illustrated in FIG. 20, the lever portion 122C of each of the actuators 122 is fitted in the pair of the holder parts 112D included in the slider 112 from the lower side (the Z-axis negative side), to be held by the pair of holder parts 112D. Accordingly, the operating force is transmitted to each of the actuators 122 from the slider 112 as the slider 112 slides, and thereby, the actuator 122 rotates around the rotating shaft portion 122A.

(Operations of the Slide Mechanism)

Figure 21:
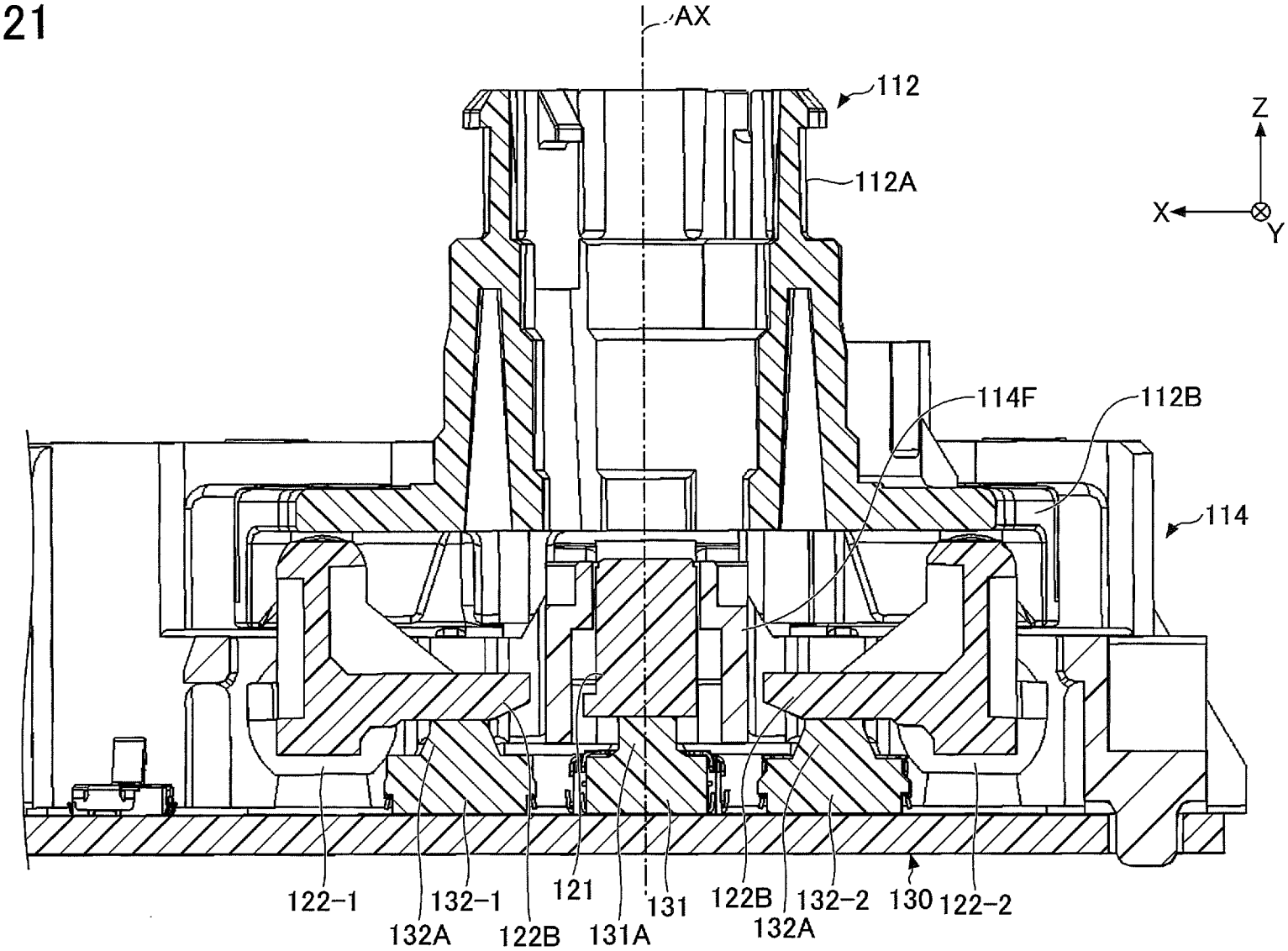
FIG. 21 is a cross-sectional view of a slide mechanism provided in the switching device (in a state of no sliding operation being performed) according to the one embodiment.
Figure 22:
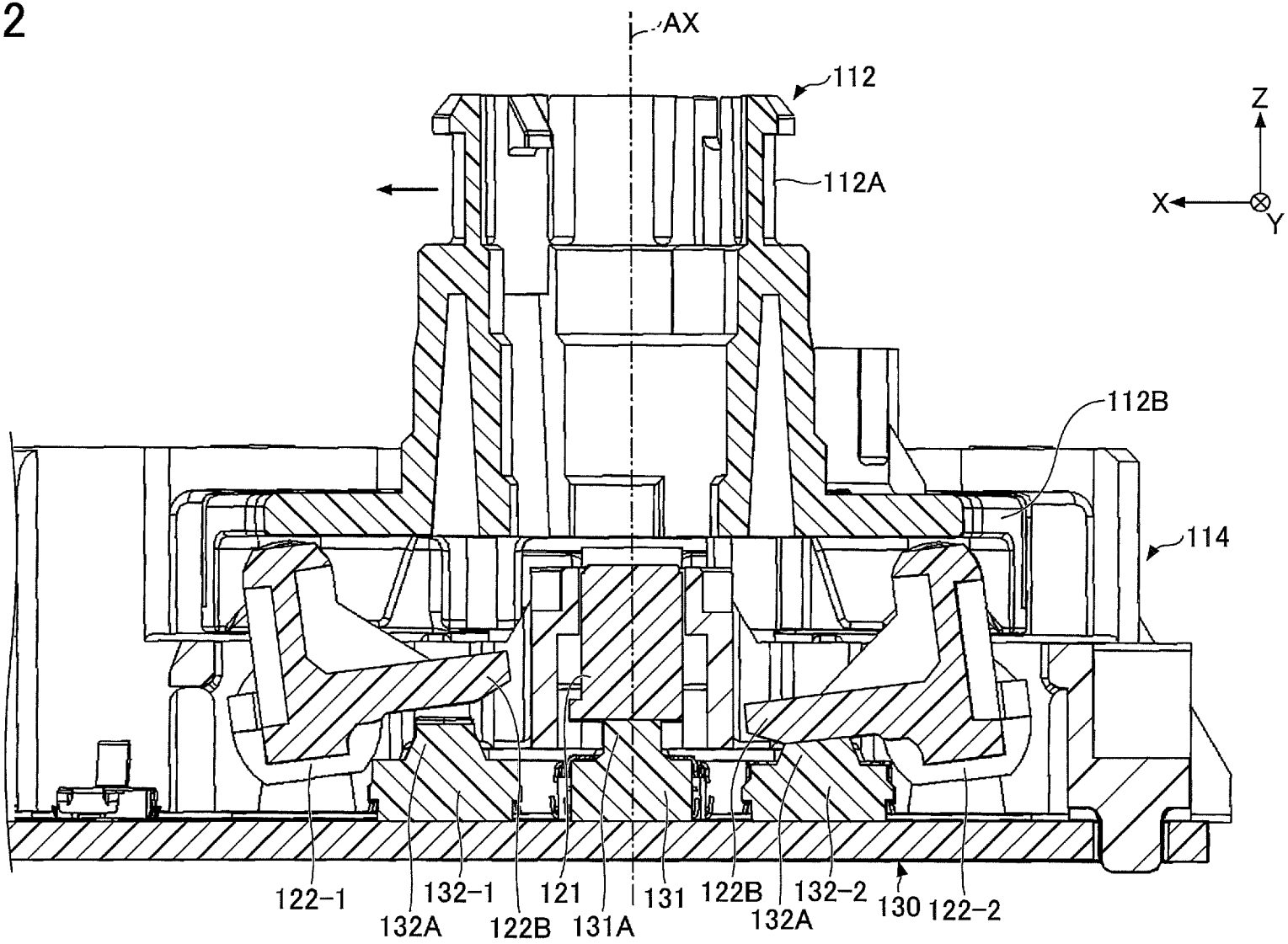
FIG. 22 is a cross-sectional view of the slide mechanism provided in the switching device (in a state of a sliding operation being performed) according to the one embodiment.

Next, with reference to FIGS. 21 and 22, operations of the slide mechanism included in the switching device 100 according to the one embodiment will be described. FIG. 21 is a cross-sectional view of the slide mechanism provided in the switching device 100 (in a state of no sliding operation being performed) according to the one embodiment. FIG. 22 is a cross-sectional view of the slide mechanism provided in the switching device 100 (in a state of a sliding operation being performed) according to the one embodiment.

As illustrated in FIG. 21, when a sliding operation on the operation part 100B is not being performed, the slider 112 is in a state of having its center positioned at the central axis AX.

At this time, as illustrated in FIG. 20, the operating force from the slider 112 is not transmitted to any of the actuators 122, and thereby, and the horizontal state of the actuator 122 is maintained by being biased on the lower side (the Z-axis negative side), by the returning force from the corresponding one of the slide detection switches 132.

Then, as illustrated in FIG. 21, once a sliding operation is performed on the operation part 100B, the slider 112 slides in the slide operation direction together with the operation part 100B, in a state of the sliding portion 112B being contained in the recess 114A of the subcase 114.

Accordingly, as illustrated in FIG. 21, the actuator 122 present in the slide operation direction and the actuator 122 present in a direction opposite to the slide operation direction, which are held by the slider 112, rotate in response to the operating force being transmitted from the slider 112.

However, as illustrated in FIG. 21, the actuator 122 present in the slide operation direction rotates such that the arm portion 122B is pushed upward (in the Z-axis positive direction). On the other hand, the actuator 122 present in the direction opposite to the slide operation direction rotates such that the arm portion 122B is pushed downward (the Z-axis negative direction).

As a result, as illustrated in FIG. 21, the arm portion 122B of the actuator 122 in the direction opposite to the slide operation direction presses the slide detection switch 132 arranged on the lower side.

In response to being pressed by the arm portion 122B of the actuator 122 from the upper side, the slide detection switch 132 is switched to a switch-on state.

Note that FIG. 21 illustrates an example in which a sliding operation is performed on the operation part 100B in the forward direction (the X-axis positive direction). In this case, the slider 112 slides in the forward direction (the X-axis positive direction) together with the operation part 100B.

Accordingly, as illustrated in FIG. 21, the actuator 122-1 present in the forward direction (the X-axis positive direction) and the actuator 122-2 present in the backward direction (the X-axis negative direction) that are held by the slider 112, rotate by a lever operation caused by the slider 112.

However, as illustrated in FIG. 21, the actuator 122-1 present in the forward direction (the X-axis positive direction) rotates such that the arm portion 122B is pushed upward (in the Z-axis positive direction). On the other hand, the actuator 122-2 present in the backward direction (the X-axis negative direction) rotates such that the arm portion 122B is pushed downward (the Z-axis negative direction).

As a result, as illustrated in FIG. 21, the arm portion 122B of the actuator 122-2 present in the backward direction (the X-axis negative direction) presses the slide detection switch 132-2 arranged on the lower side.

In response to being pressed by the arm portion 122B of the actuator 122-2 from the upper side, the slide detection switch 132-2 is switched to a switch-on state.

Note that once the sliding operation on the operation part 100B is released, the arm portion 122B of the actuator 122 is pushed upward (the Z-axis positive direction) by the returning force from the slide detection switch 132, in the direction opposite to the slide operation direction. Accordingly, the actuator 122 present in the direction opposite to the slide operation direction returns to the initial state (a state of the arm portion 122B being horizontal) before the sliding operation was performed. At this time, the actuator 122 present in the direction opposite to the slide operation direction causes the lever portion 122C to bias the slider 112 in the direction opposite to the slide operation direction. Accordingly, the slider 112 returns to the initial position (the position at which the center is located on the central axis AX) before the sliding operation was performed.

In this way, according to the one embodiment, the switching device 100 includes the operation part 100B to receive the operating force; the slider 112 to slide by the operating force from the operation part 100B; the subcase 114 to support the slider 112 to be slidable; the actuator 122 rotatably supported by the subcase 114, to rotate upon being biased by the slider 112 as the slider 112 slides; and the slide detection switch 132 to perform a switching operation by rotation of the actuator 122.

Then, in the switching device 100 according to the one embodiment, the actuator 122 returns to the state before rotation by the returning force from the slide detection switch 132, once the operating force is released. Also, the actuator 122 having received the returning force transmits the returning force to the slider 112, to cause the slider 112 to return to the initial position before sliding.

Further, in the switching device 100 according to the one embodiment, the slider 112 is slidable in multiple sliding directions, and includes the actuator 122 and the slide detection switch 132 in each of the multiple sliding directions.

Accordingly, in the switching device 100 according to the one embodiment, by having the actuator 122 directly biased by the slider 112, the reliability of an operation of transmitting the operating force from the slider 112 to the actuator 122 can be increased.

Also, by providing the actuator 122 and the slide detection switch 132 in each of the slide operation directions, in the switching device 100 according to the one embodiment, the reliability of an operation of transmitting the operating force to the actuator 122 and the slide detection switch 132 can be increased.

(First Simultaneous Operation Prohibition Mechanism)

Figure 23:
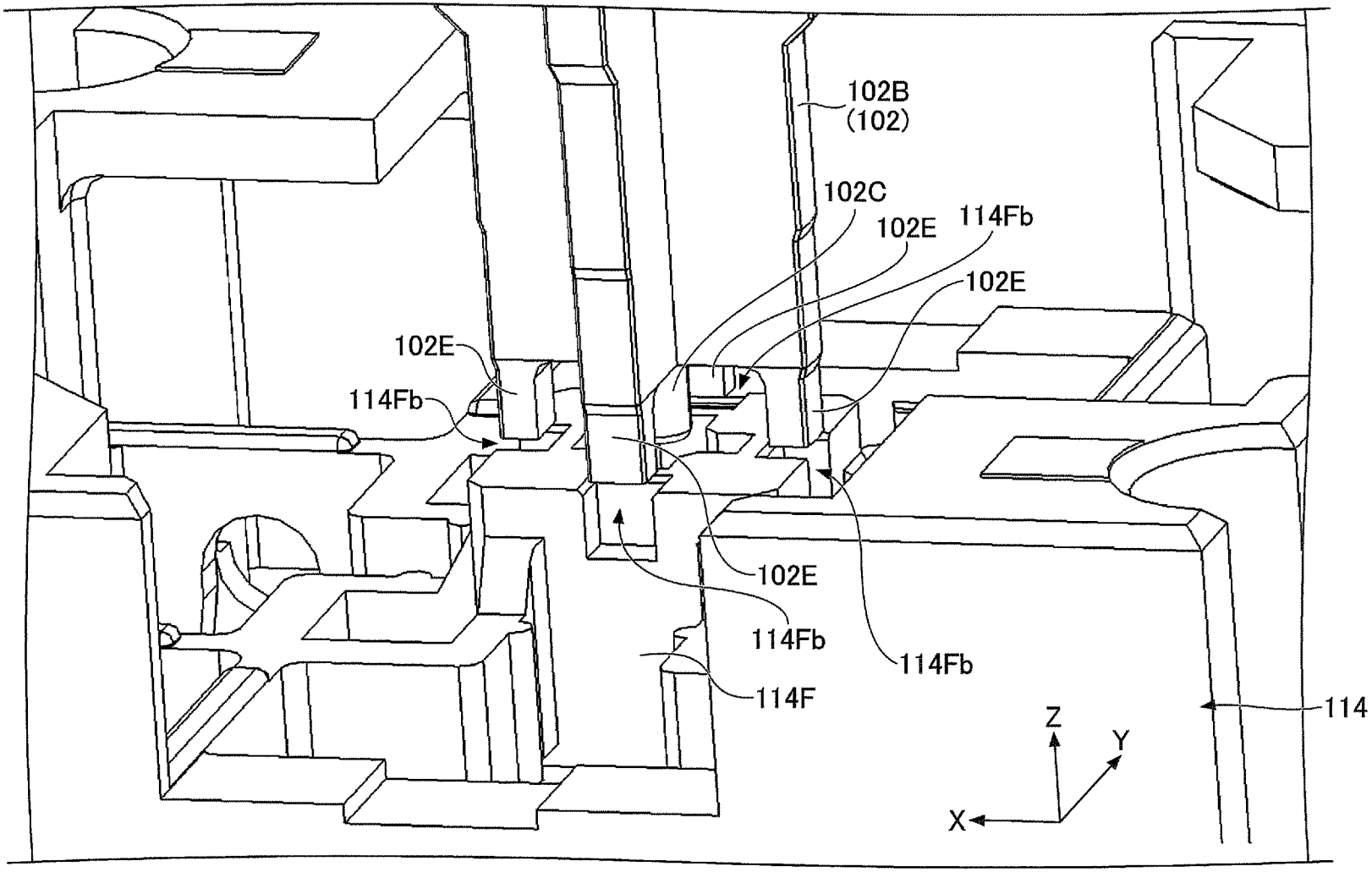
FIG. 23 is a partially enlarged perspective view illustrating a first simultaneous operation prohibition mechanism included in the switching device (in a state of no operation being performed) according to the one embodiment.

FIG. 23 is a partially enlarged perspective view illustrating a first simultaneous operation prohibition mechanism included in the switching device 100 (in a state of no operation being performed) according to the one embodiment. As illustrated in FIG. 23, in the surroundings of the protruding part 102C at the lower end of the shaft portion 102B of the knob 102, four fitting protrusions 102E each having a shape of a quadrangular prism are formed to protrude downward. On the other hand, in a supporting part 114F of the subcase 114, four fitting recesses 114Fb each having a shape of a quadrangular prism are famed at positions on the lower side of the four fitting protrusions 102E, to have a shape recessed from the top of the supporting part 114F toward the lower side.

As illustrated in FIG. 23, when no operation is performed on the operation part 100B, each of the four fitting protrusions 102E is not fitted into the corresponding one of the four fitting recesses 114Fb. Therefore, on the switching device 100 according to the one embodiment, either of a pressing operation on the knob 102 or a sliding operation on the operation part 100B can be selectively performed, in a state of no operation being performed on the operation part 100B as illustrated in FIG. 23.

Figure 24:
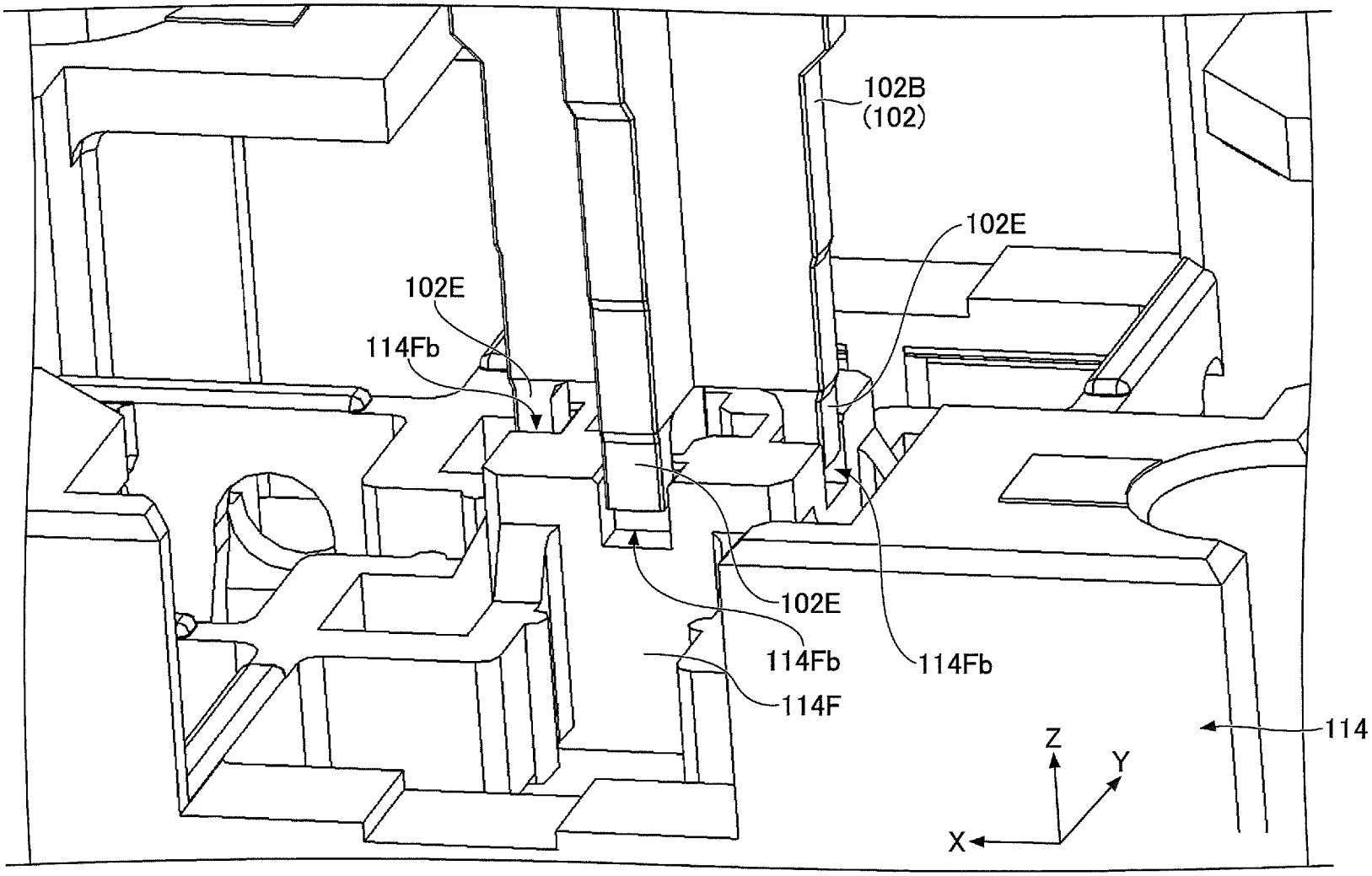
FIG. 24 is a partially enlarged perspective view illustrating the first simultaneous operation prohibition mechanism included in the switching device (in a state of a pressing operation being performed) according to the one embodiment.

FIG. 24 is a partially enlarged perspective view illustrating the first simultaneous operation prohibition mechanism included in the switching device 100 (in a state of a pressing operation being performed) according to the one embodiment. As illustrated in FIG. 24, when a pressing operation is performed on the knob 102, each of the four fitting protrusions 102E enters the corresponding one of the four fitting recesses 114Fb, to be fitted. This restricts the movement of the knob 102 in the horizontal direction. This prevents, in a state of a pressing operation being performed on the knob 102 as illustrated in FIG. 24, the switching device 100 according to the one embodiment from executing a sliding operation on the operation part 100B simultaneously.

Figure 25:
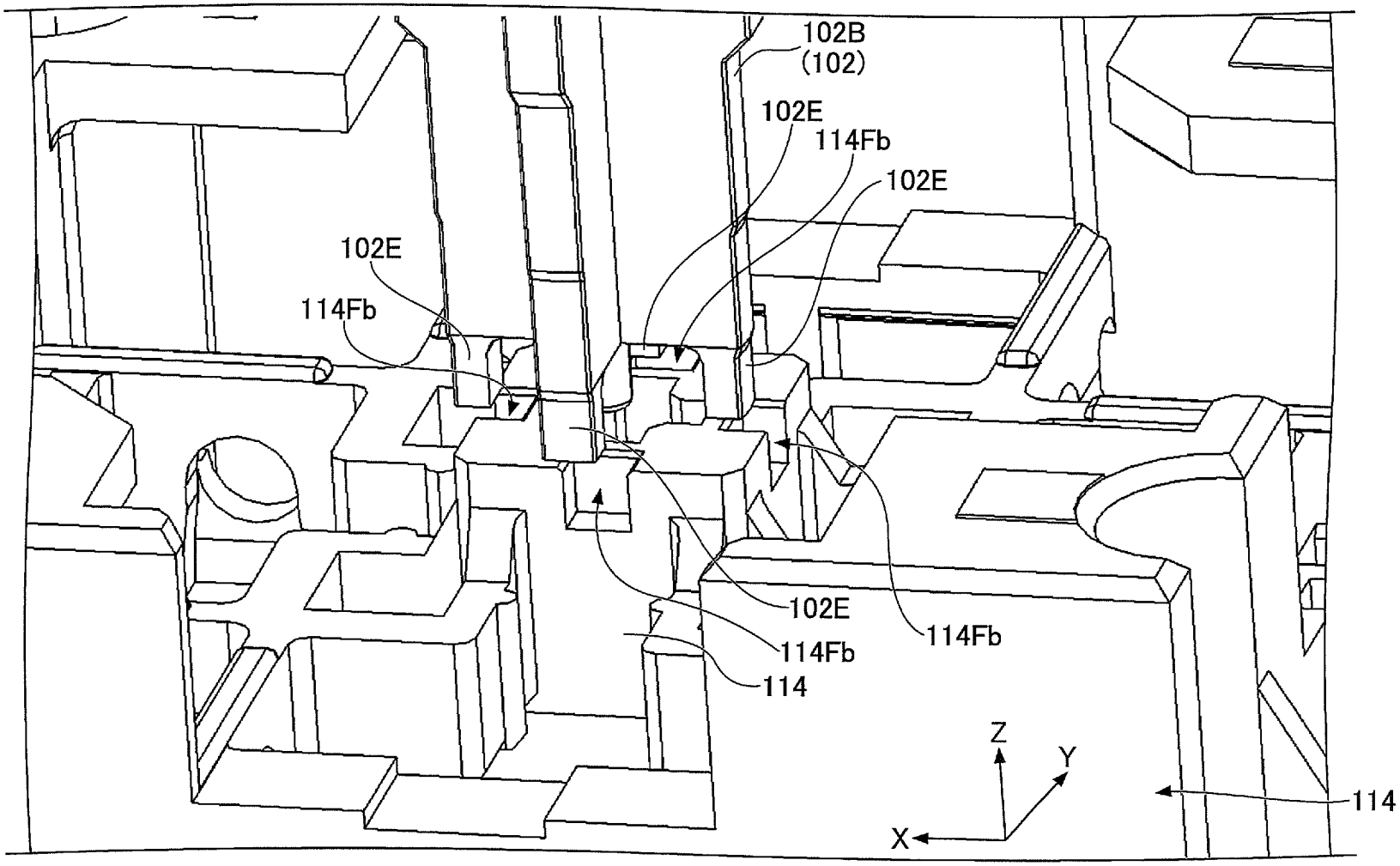
FIG. 25 is a partially enlarged perspective view illustrating the first simultaneous operation prohibition mechanism included in the switching device (in a state of a sliding operation being performed) according to the one embodiment.

FIG. 25 is a partially enlarged perspective view illustrating the first simultaneous operation prohibition mechanism included in the switching device 100 (in a state of a sliding operation being performed) according to the one embodiment. As illustrated in FIG. 25, when a sliding operation is performed on the operation part 100B, each of the four fitting protrusions 102E moves in the horizontal direction, to hit the top surface of the supporting part 114F, and thereby, becomes unable to enter the corresponding one of the four fitting recesses 114Fb. This restricts the movement of the knob 102 in the downward direction. This prevents, in a state of a sliding operation being performed on the operation part 100B as illustrated in FIG. 25, the switching device 100 according to the one embodiment from executing the pressing operation on the knob 102 simultaneously.

(Second Simultaneous Operation Prohibition Mechanism)

Figure 26:
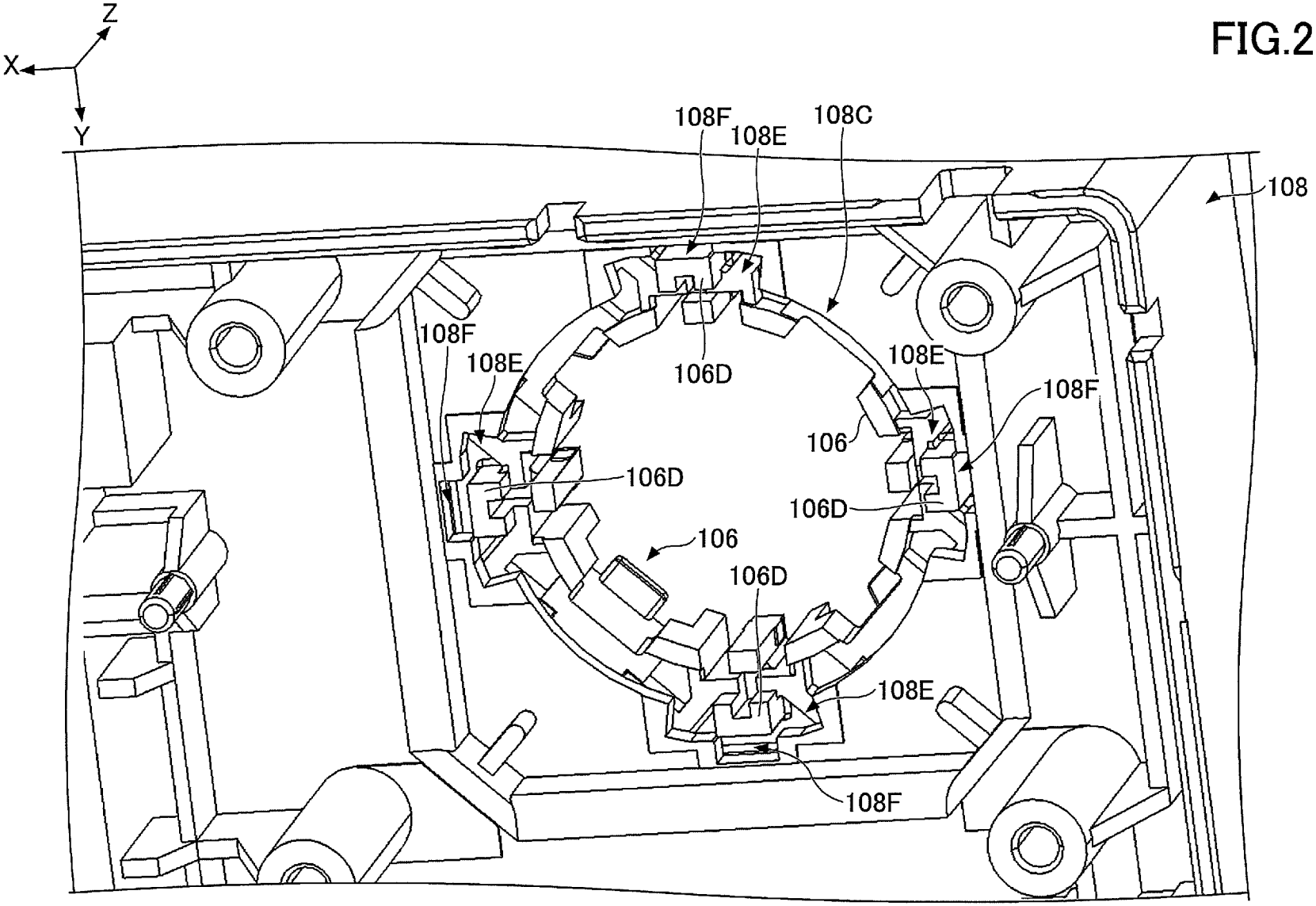
FIG. 26 is a partially enlarged perspective view illustrating a second simultaneous operation prohibition mechanism included in the switching device (in a state of no operation being performed) according to the one embodiment.

FIG. 26 is a partially enlarged perspective view illustrating the second simultaneous operation prohibition mechanism included in the switching device 100 (in a state of no operation being performed) according to the one embodiment. As illustrated in FIG. 26, four protrusions 106D (examples of a "restricted part") each having a quadrangular prism shape, protruding downward are provided in the first holder 106 arranged at 90-degree intervals. On the other hand, along the inner periphery of the opening portion 108C of the case 108, four second recesses 108F (examples of a "second restricting part") arranged at 90-degree intervals are formed by being cut off outward. Further, in each of the four first recesses 108E, a second recess 108F (an example of a "first restricting part") is formed by being cut off outward.

Figure 37:
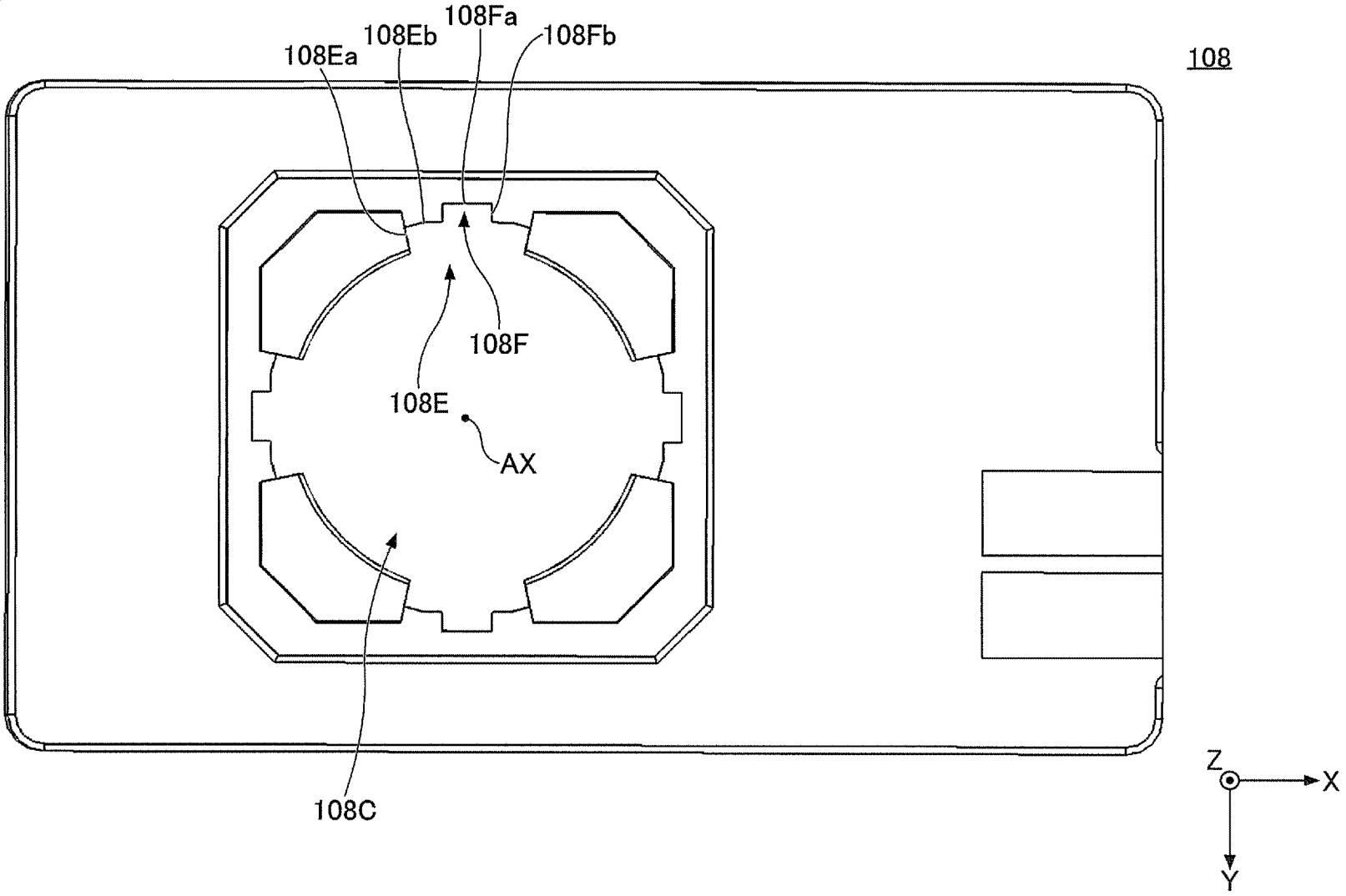
FIG. 37 is a top view of a case provided in the switching device according to the one embodiment.

As illustrated in FIG. 26, when no operation is performed on the operation part 100B, each of the four protrusions 106D is in a state of having entered the corresponding one of the four first recesses 108E, but not engaged with the corresponding one of the four first recesses 108E and the corresponding one of the four second recesses 108F. Therefore, on the switching device 100 according to the one embodiment, either of a pressing operation on the operation part 100B or a sliding operation on the operation part 100B can be selectively performed, in a state of no operation being performed on the operation part 100B as illustrated in FIG. 26. As illustrated in FIG. 37, the first recess 108E is constituted with a wall 108Ea arranged in a direction that crosses a direction of a rotating operation around the center of rotation being the central axis AX applied to the operation part 100B; and a wall 108Eb provided substantially parallel to the direction of the rotating operation. The wall 108Ea defines an angular range upon performing a rotating operation on the operation part 100B. The wall 108Ea is provided at a position contacting a side surface of the protrusion 106D when the operation part 100B receives a rotating operation of a predetermined angle of rotation. Note that in the present embodiment, when the operation part 100B receives an operation of rotating by 12 degrees from the initial state, the protrusion 106D comes into contact with the wall 108Ea. The second recess 108F is constituted with a wall 108Fa arranged in a direction crossing a straight line extending from the central axis AX in the XY-plane direction; and a wall 108Fb arranged to be substantially parallel to a straight line extending from the central axis AX in the XY-plane direction. The wall 108Fa defines a range of operating distance upon performing a sliding operation on the operation part 100B.

Figure 27:
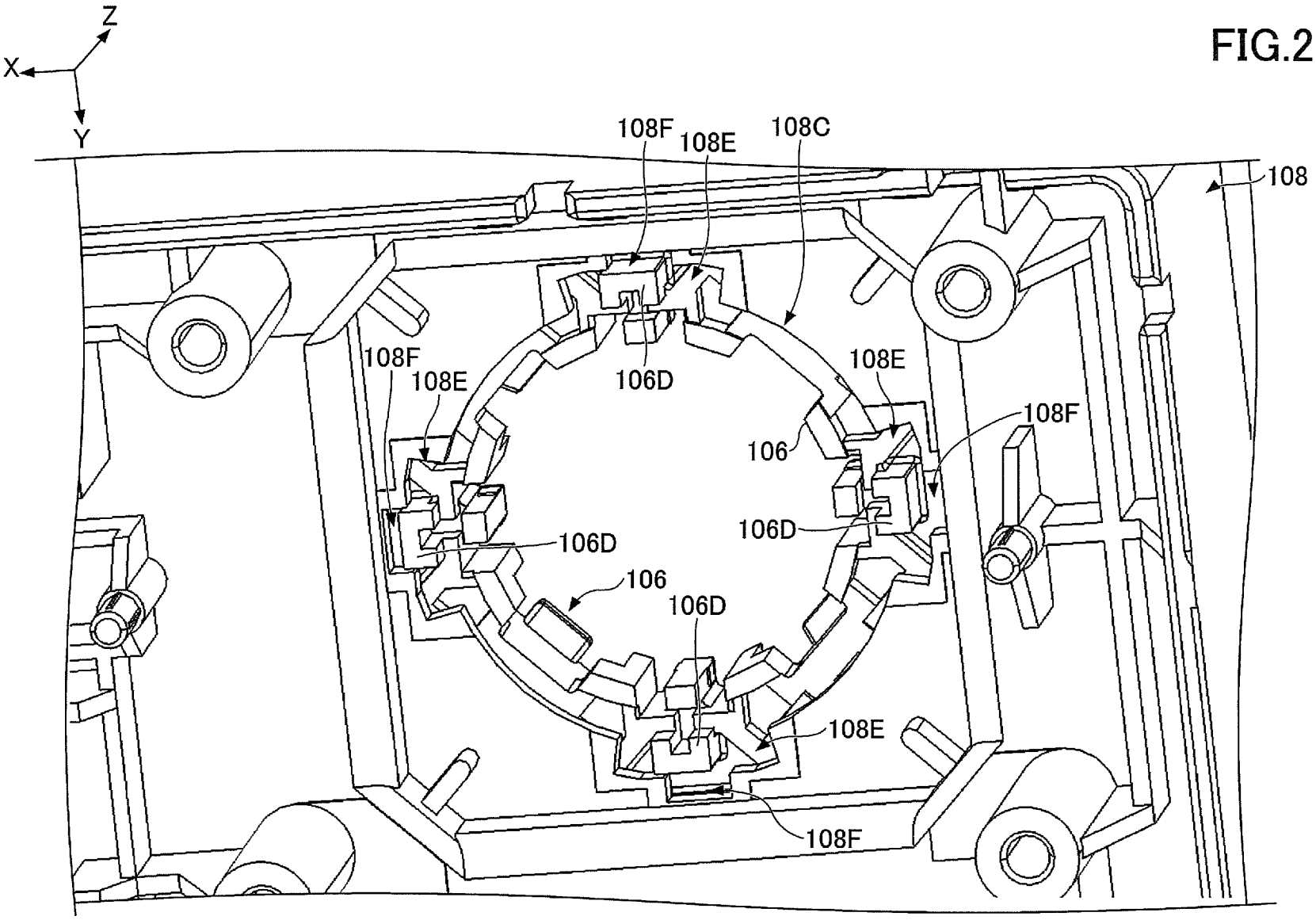
FIG. 27 is a partially enlarged perspective view illustrating the second simultaneous operation prohibition mechanism included in the switching device (in a state of a sliding operation being performed) according to the one embodiment.

FIG. 27 is a partially enlarged perspective view illustrating the second simultaneous operation prohibition mechanism included in the switching device 100 (in a state of a sliding operation being performed) according to the one embodiment. As illustrated in FIG. 27, when a sliding operation is performed on the operation part 100B, one of the protrusion 106D present in the slide operation direction enters the corresponding one of the second recess 108F in the slide operation direction. This restricts the rotation of the first holder 106. This prevents, in a state of a sliding operation being performed on the operation part 100B as illustrated in FIG. 27, the switching device 100 according to the one embodiment from executing the rotating operation on the operation part 100B simultaneously.

Figure 28:
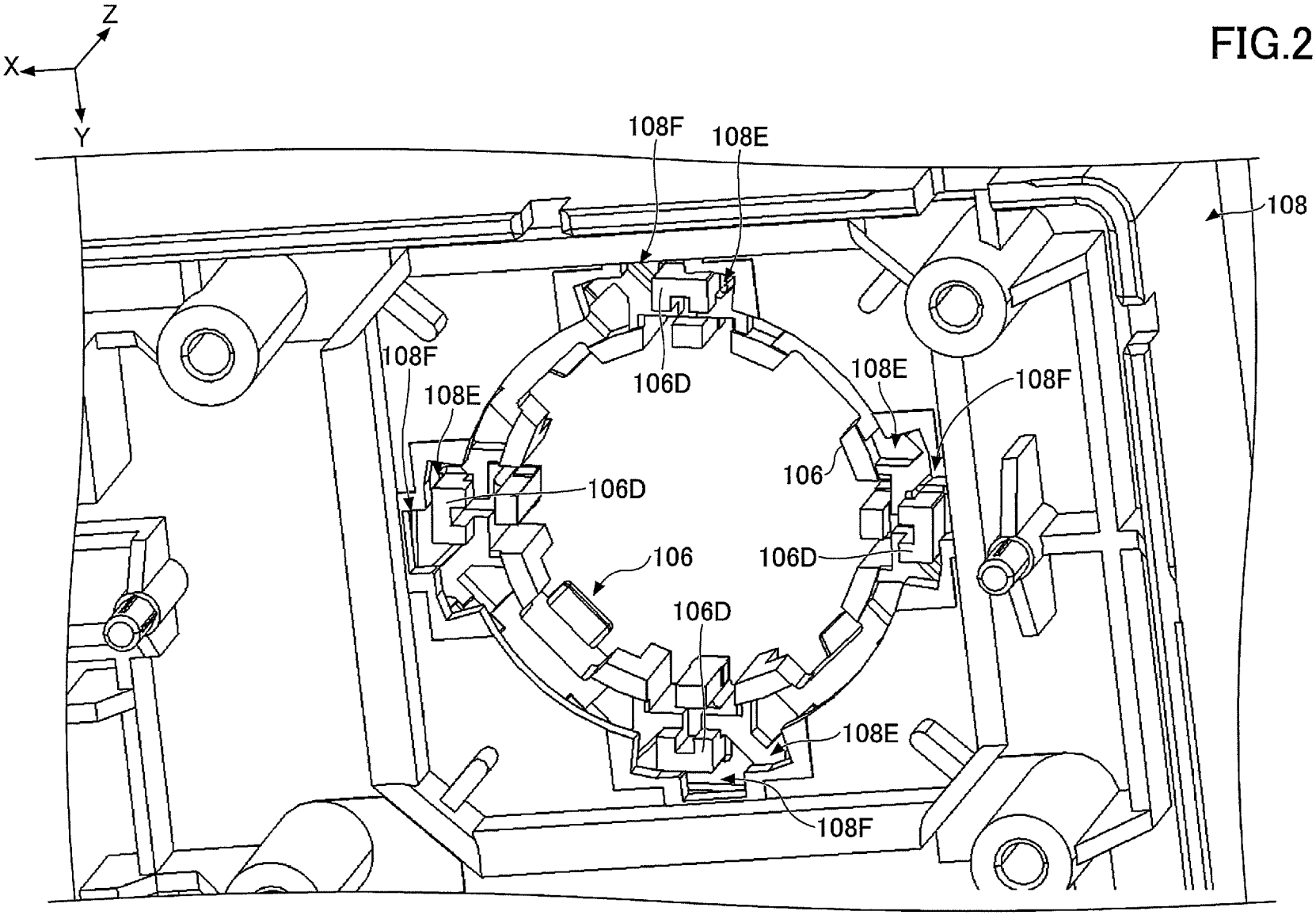
FIG. 28 is a partially enlarged perspective view illustrating the second simultaneous operation prohibition mechanism included in the switching device (in a state of a rotating operation being performed) according to the one embodiment.

FIG. 28 is a partially enlarged perspective view illustrating the second simultaneous operation prohibition mechanism included in the switching device 100 (in a state of a rotating operation being performed) according to the one embodiment. As illustrated in FIG. 28, when a rotating operation is performed on the operation part 100B, each of the four protrusions 106D rotates in the direction of the rotational operation inside the corresponding one of the four first recesses 108E, to hit the inner wall surface on the outside of the first recess 108E, and thereby, becomes unable to enter the second recess 108F. This restricts the movement of the knob 102 in the horizontal direction. This prevents, in a state of a rotating operation being performed on the operation part 100B as illustrated in FIG. 28, the switching device 100 according to the one embodiment from executing the sliding operation on the operation part 100B simultaneously. Note that in the present embodiment, although a configuration is described in which the protrusion 106D is part of the first holder 106, the protrusion 106D may be formed as part of the second holder 2 or part of the decorative member 104. In any case of being formed as part of one of these members, the protrusion 106D is formed to have a shape and arrangement associated with the first recess 108E of the case 108 and the second recess 108F.

(Third Simultaneous Operation Prohibition Mechanism)

Figure 29:
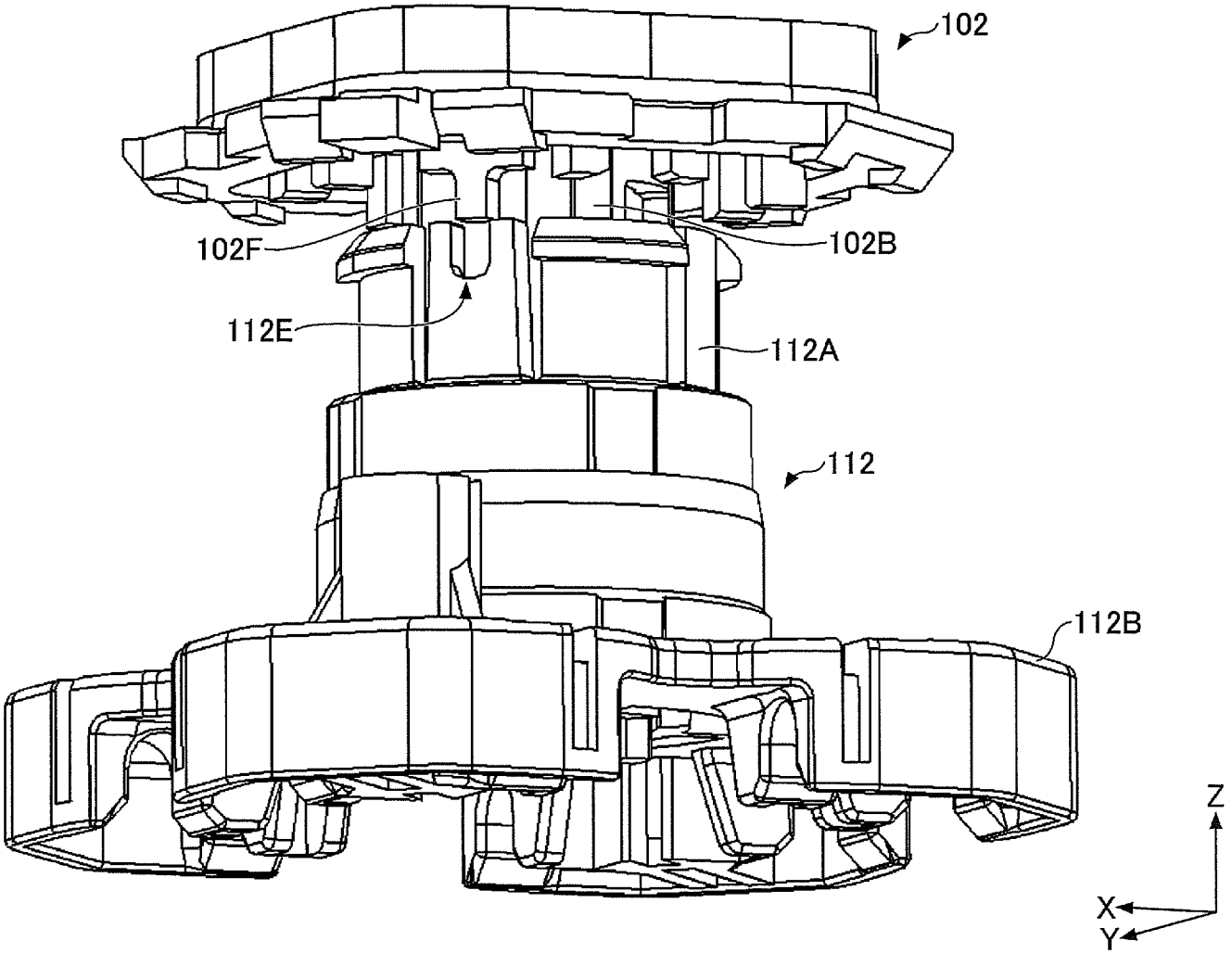
FIG. 29 is a partially enlarged perspective view illustrating a third simultaneous operation prohibition mechanism included in the switching device (in a state of no operation being performed) according to the one embodiment.

FIG. 29 is a partially enlarged perspective view illustrating a third simultaneous operation prohibition mechanism included in the switching device 100 (in a state of no operation being performed) according to the one embodiment. As illustrated in FIG. 29, a protrusion 102F having a circular column shape is provided in the outer periphery of the shaft portion 102B of the knob 102 protruding outward. On the other hand, at the upper edge of the cylindrical portion 112A of the slider 112, a recessed 112E is formed by being cut off downward.

As illustrated in FIG. 29, when no operation is performed on the operation part 100B, the protrusion 102F is positioned above the recess 112E, and not engaged with the recess 112E. Therefore, on the switching device 100 according to the one embodiment, either of a pressing operation on the knob 102 or a sliding operation on the operation part 100B can be selectively performed, in a state of no operation being performed on the operation part 100B as illustrated in FIG. 29.

Figure 30:
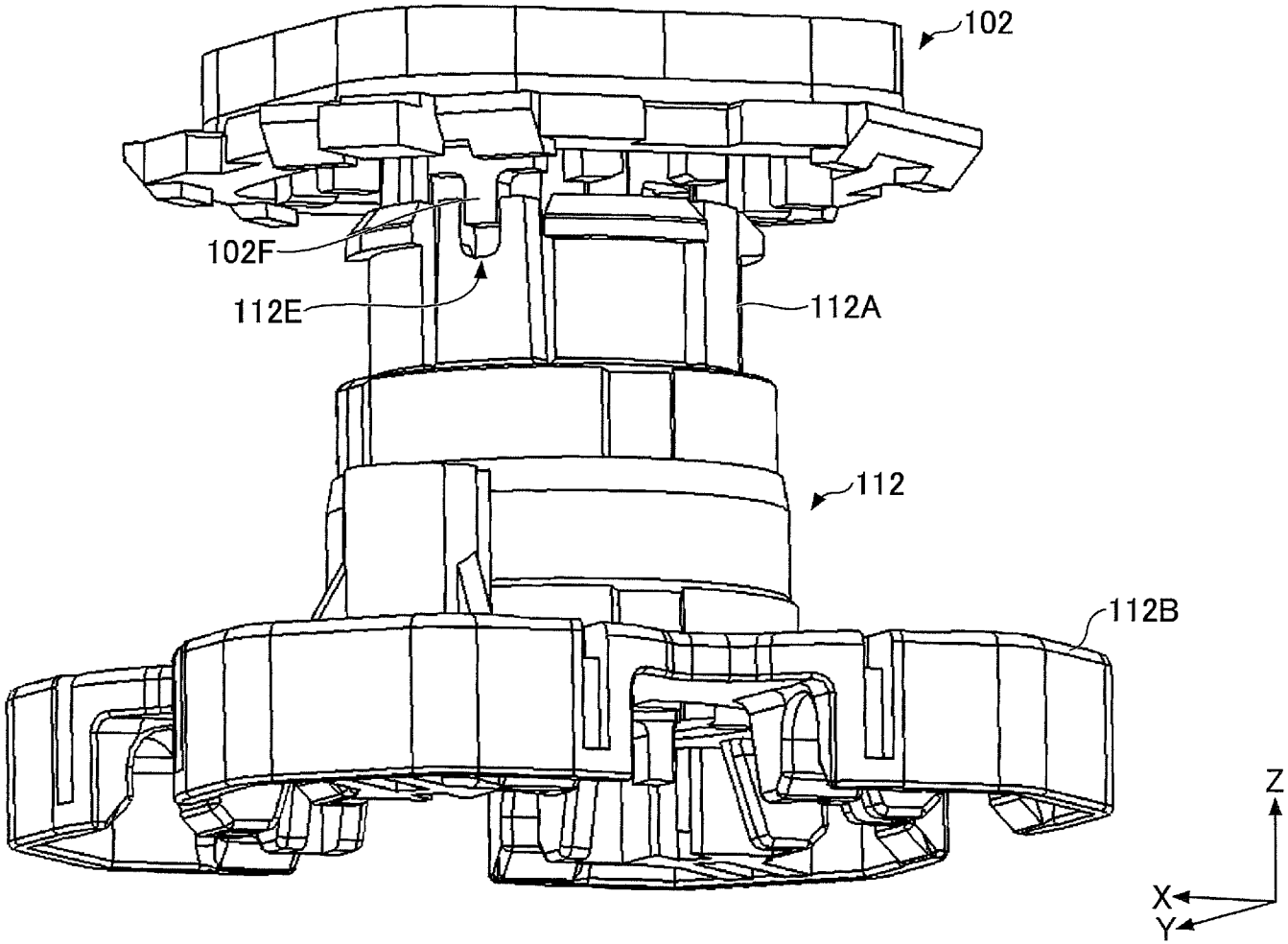
FIG. 30 is a partially enlarged perspective view illustrating the third simultaneous operation prohibition mechanism included in the switching device (in a state of a pressing operation being performed) according to the one embodiment.

FIG. 30 is a partially enlarged perspective view illustrating the third simultaneous operation prohibition mechanism included in the switching device 100 (in a state of a pressing operation being performed) according to the one embodiment. As illustrated in FIG. 30, when a pressing operation is performed on the knob 102, the protrusion 102F enters the recess 112E. This restricts the rotation of the knob 102. This prevents, in a state in which a pressing operation is performed on the knob 102 as illustrated in FIG. 30, the switching device 100 according to the one embodiment from executing the rotating operation on the operation part 100B simultaneously.

Figure 31:
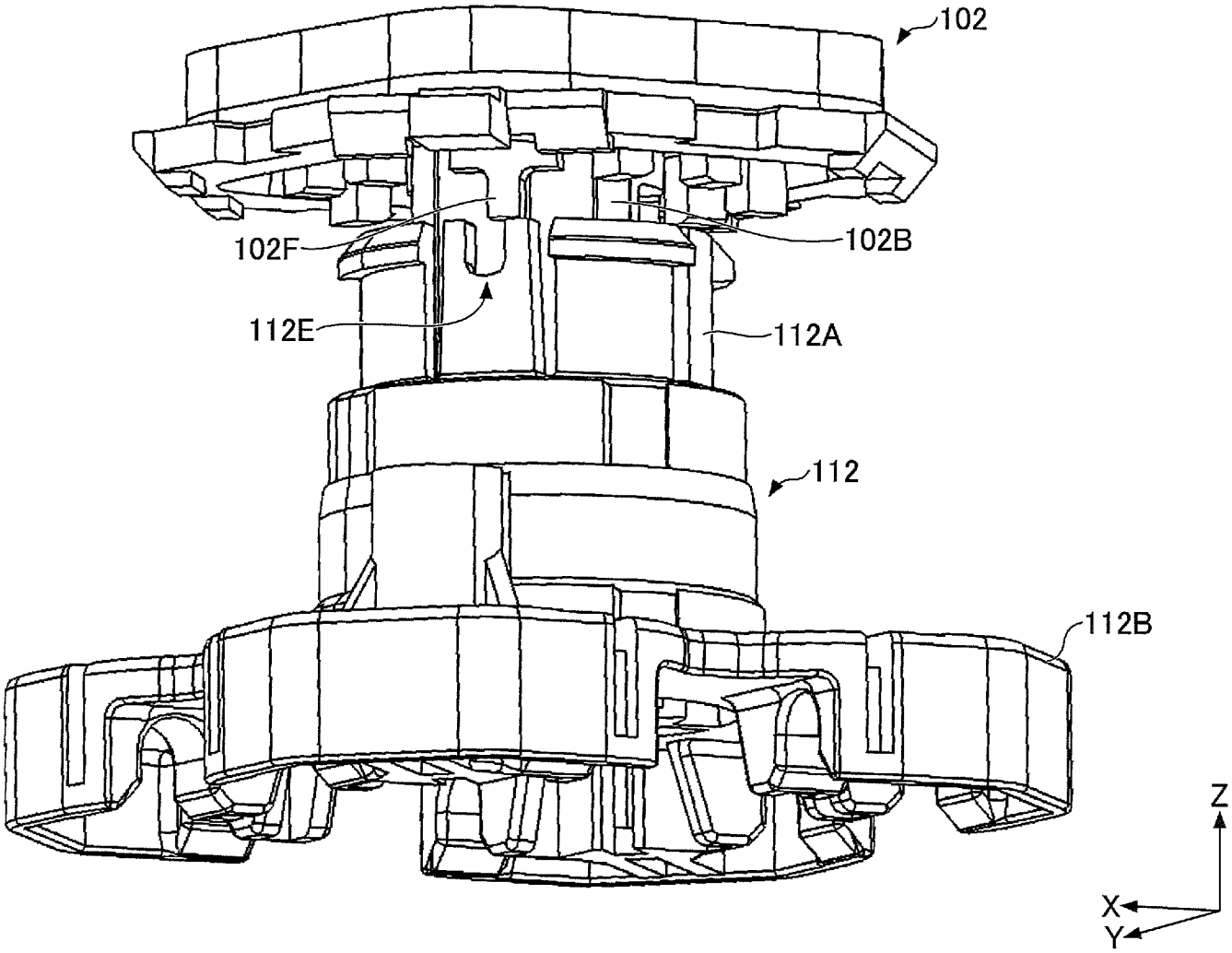
FIG. 31 is a partially enlarged perspective view illustrating the third simultaneous operation prohibition mechanism included in the switching device (in a state of a rotating operation being performed) according to the one embodiment.

FIG. 31 is a partially enlarged perspective view illustrating the third simultaneous operation prohibition mechanism included in the switching device 100 (in a state of a rotating operation being performed) according to the one embodiment. As illustrated in FIG. 31, when a rotating operation is performed on the operation part 100B, the protrusion 102F rotating in the direction of the rotational operation hits the upper edge of the cylindrical portion 112A of the slider 112, and thereby, becomes unable to enter the recess 112E. This restricts the movement of the knob 102 in the downward direction. Therefore, on the switching device 100 according to the one embodiment, in a state of a rotating operation being performed on the operation part 100B illustrated in FIG. 31, the pressing operation on the knob 102 cannot be performed simultaneously.

Figure 32:
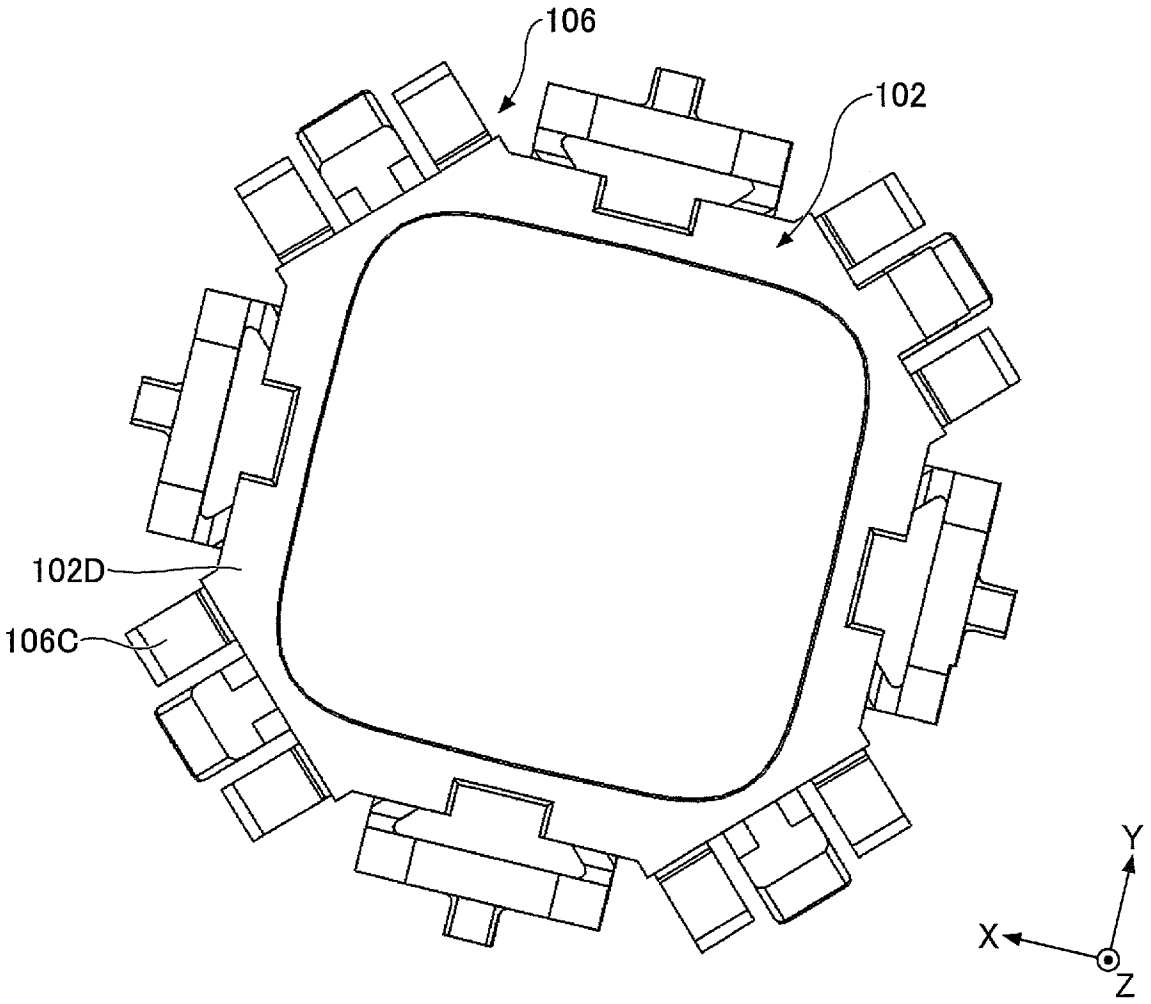
FIG. 32 is a top view of the knob and the first holder provided in the switching device according to the one embodiment.
Figure 33:
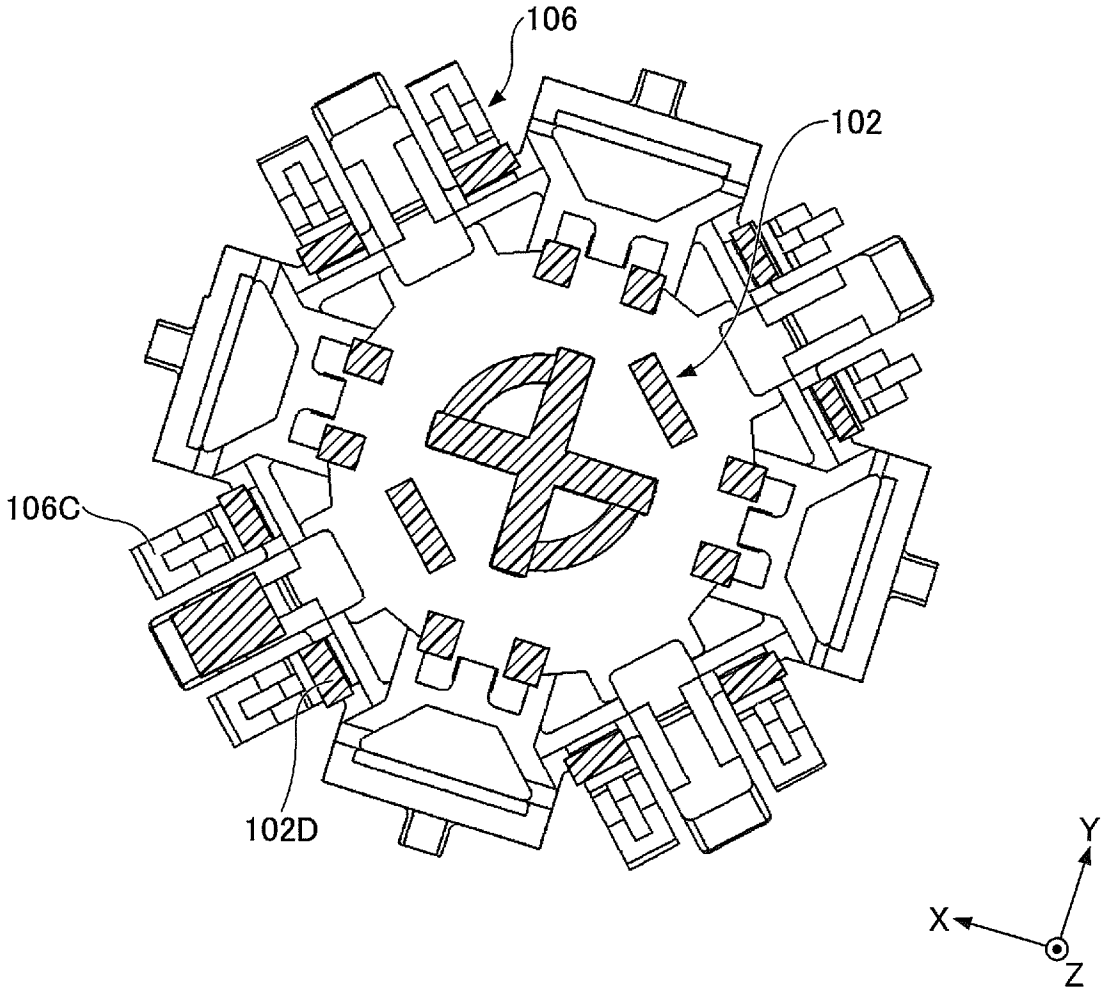
FIG. 33 is a cross-sectional view sectioned by the XY-plane of the knob and the first holder included in the switching device according to the one embodiment.
Figure 34:
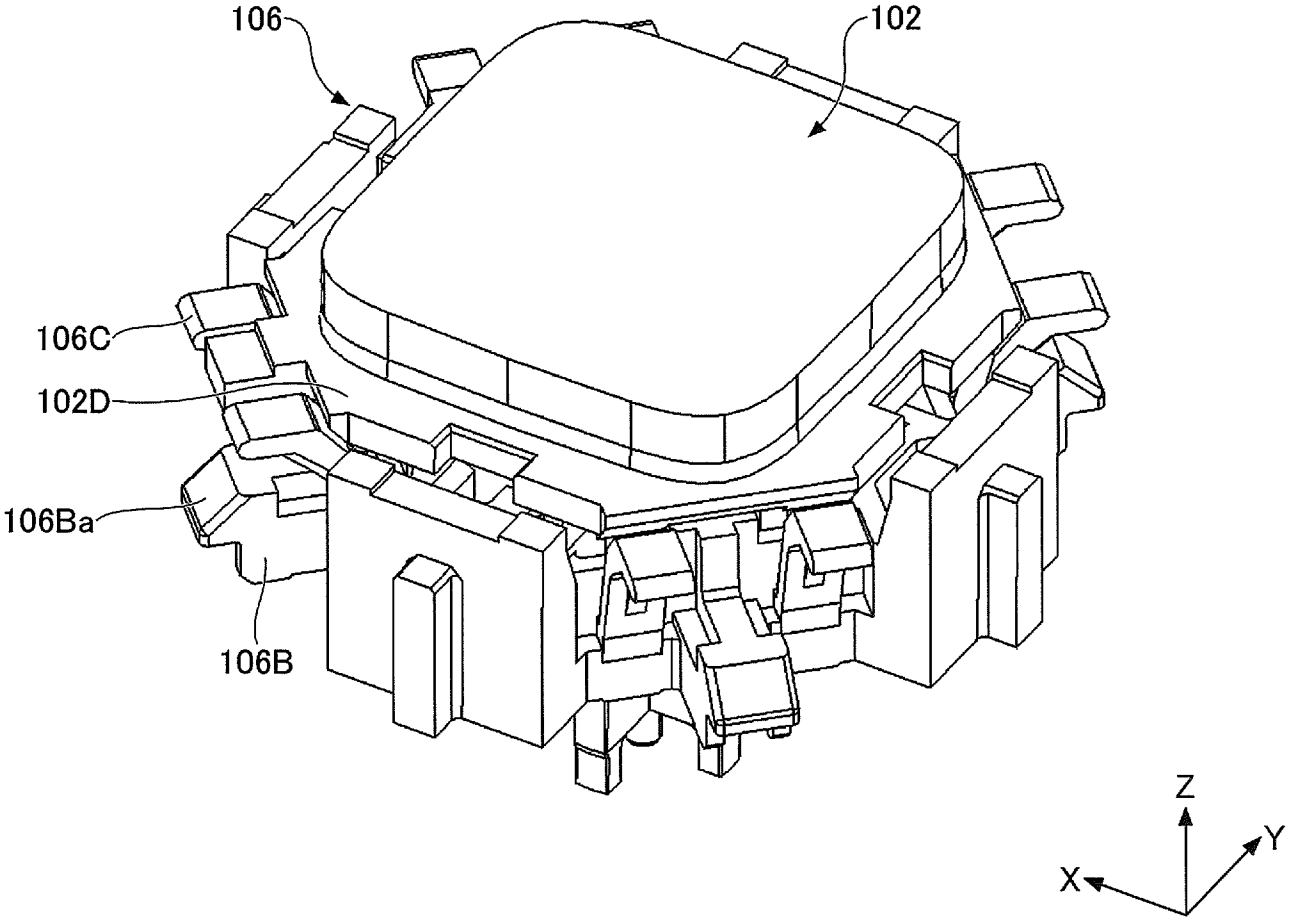
FIG. 34 is an external perspective view of the knob and the first holder provided in the switching device according to the one embodiment.

FIG. 32 is a top view of the knob 102 and the first holder 106 provided in the switching device 100 according to the one embodiment. FIG. 33 is a cross-sectional view sectioned by the XY-plane of the knob 102 and the first holder 106 included in the switching device 100 according to the one embodiment. FIG. 34 is an external perspective view of the knob 102 and the first holder 106 provided in the switching device 100 according to the one embodiment. As illustrated in FIGS. 32 to 34, the knob 102 and the first holder 106 are arranged to overlap in the up-and-down direction, and arranged at positions that overlap in plan view.

Figure 35:
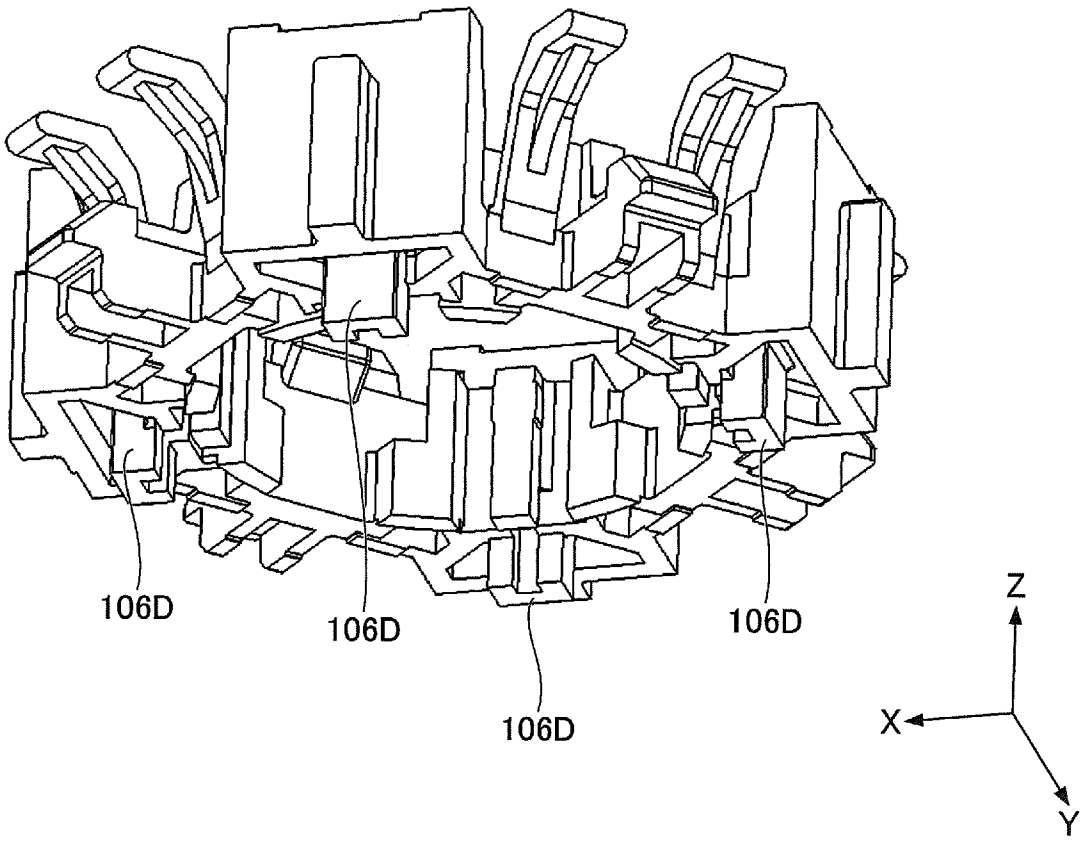
FIG. 35 is a downward perspective view of the first holder provided in the switching device according to the one embodiment.
Figure 36:
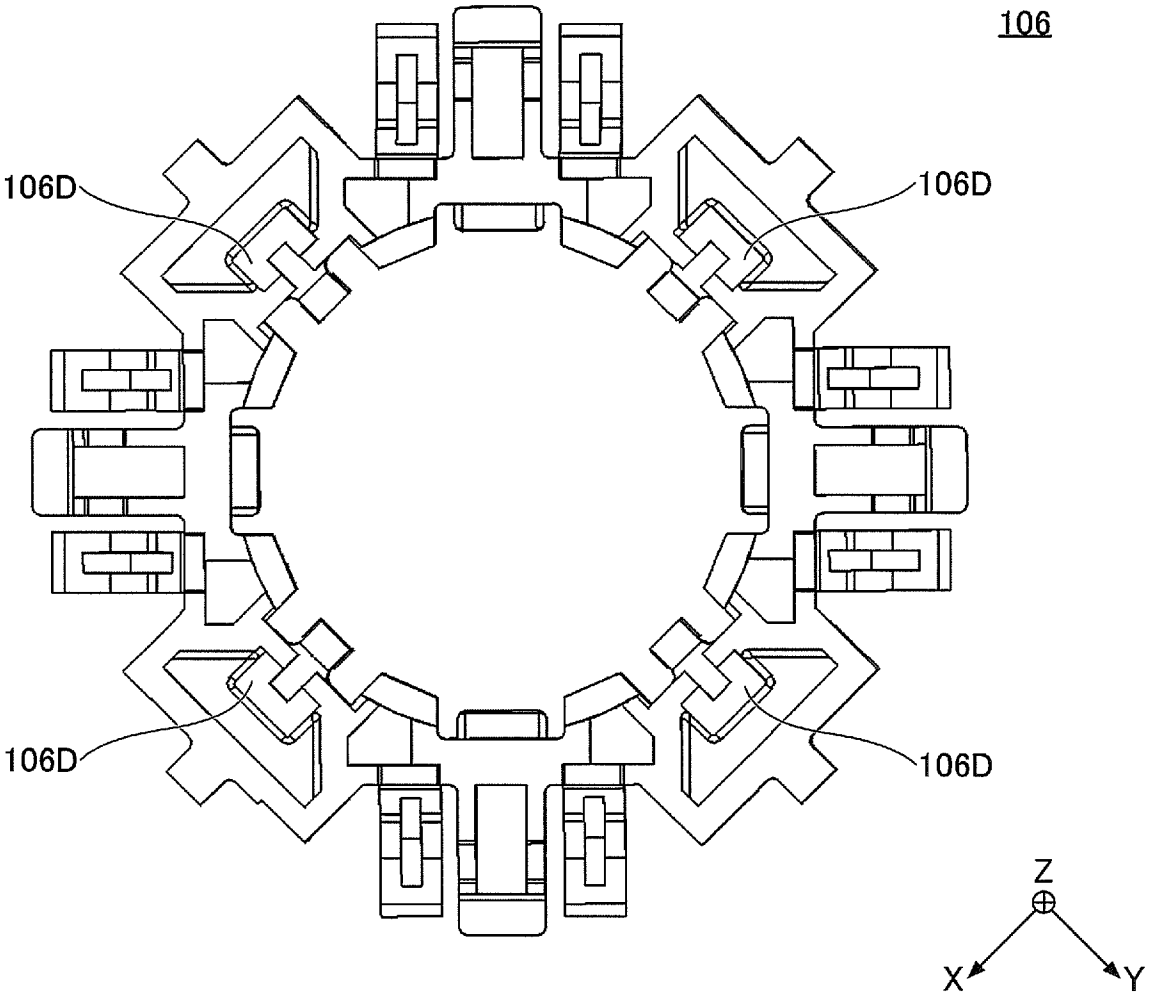
FIG. 36 is a bottom view of the first holder provided in the switching device according to the one embodiment.

FIG. 35 is a downward perspective view of the first holder 106 provided in the switching device 100 according to the one embodiment. FIG. 36 is a bottom view of the first holder 106 provided in the switching device 100 according to the one embodiment. FIG. 37 is a top view of the case 108 provided in the switching device 100 according to the one embodiment. As illustrated in FIGS. 35 and 36, four protrusions 106D each having a quadrangular prism shape and protruding downward are formed in the first holder 106 to be arranged at 90-degree intervals.

On the other hand, as illustrated in FIG. 37, along the inner periphery of the opening portion 108C of the case 108, four first recesses 108E arranged at 90-degree intervals are formed by being cut off outward. Further, in each of the four first recesses 108E, a second recess 108F is formed by being cut off outward.

Also, as illustrated in FIG. 37, the first recess 108E is constituted with a wall 108Ea arranged in a direction that crosses a direction of a rotating operation around the center of rotation being the central axis AX applied to the operation part 100B; and a wall 108Eb provided substantially parallel to the direction of the rotating operation. The wall 108Ea defines an angular range upon performing a rotating operation on the operation part 100B.

Also, as illustrated in FIG. 37, the second recess 108F is constituted with a wall 108Fa arranged in a direction crossing a straight line extending from the central axis AX in the XY-plane direction; and a wall 108Fb arranged to be substantially parallel to a straight line extending from the central axis AX in the XY-plane direction. The wall 108Fa defines a range of operating distance upon performing a sliding operation on the operation part 100B.

As above, the one embodiment according to the present inventive concept has been described; note that the present inventive concept is not limited to the embodiment, and various changes and modifications can be made within the scope of the present inventive concept as described in the claims.

For example, in the one embodiment, the rubber stem 131A of the pressing detection switch 131 is used as an example of an "elastic deformation part configured to elastically deform in response to a pressing operation being performed", but it is not limited as such. The "elastic deformation part configured to elastically deform in response to a pressing operation being performed" may be any member that is arranged on the transmission path, through which the pressure operating force applied to the knob 102 is transmitted up to the pressing detection switch 131. For example, the "elastic deformation part configured to elastically deform in response to a pressing operation being performed" may be an elastically deformable actuator that is arranged on the transmission path of the operating force of the pressing operation from the knob 102. Also, for example, the "elastic deformation part configured to elastically deform in response to a pressing operation being performed" may be part of the knob 102 including at least an elastically deformable portion.

What is claimed is:

1. A switching device comprising:

a first knob configured to receive a pressing operation in a first direction;

a pressing detection switch configured to be pressed upon transmission of an operating force of the pressing operation applied to the first knob;

a decorative member configured to decorate a periphery of the first knob; and a holder configured to engage and hold the decorative member, wherein the decorative member includes an engaged portion, wherein the holder includes an engaging portion to engage the engaged portion, wherein in response to the pressing operation being performed on the first knob by a first stroke amount, by the operating force of the pressing operation applied to the first knob being transmitted to the pressing detection switch without transmitted to the engaged portion, the pressing detection switch is pressed, and wherein in response to the pressing operation being performed on the first knob by a second stroke amount greater than the first stroke amount, by the operating force of the pressing operation applied to the first knob being transmitted to the engaged portion, the engaged portion elastically deforms, and an engaging state of the engaging portion and the engaged portion is released.

2. The switching device as claimed in claim 1, further comprising:

an elastic deformation part configured to elastically deform in response to the pressing operation being performed by the second stroke amount, provided on a transmission path through which the operating force of the pressing operation applied to the first knob is transmitted to the pressing detection switch.

3. The switching device as claimed in claim 2, wherein the elastic deformation part is an elastically deformable pressor included in the pressing detection switch.

4. The switching device as claimed in claim 2, wherein the elastic deformation part is an actuator that is elastically deformable and arranged on the transmission path.

5. The switching device as claimed in claim 2, wherein the elastic deformation part is an elastically deformable part famed as part of the first knob.

6. The switching device as claimed in claim 1, wherein the holder includes a lever part to elastically deform upon being biased by the first knob in response to the pressing operation being performed on the first knob by the second stroke amount, so as to press and elastically deform the engaged portion.

7. The switching device as claimed in claim 6, wherein in a state of no pressing operation being performed, the first knob and the holder are arranged to be separated by a predetermined interval smaller than the second stroke amount, and wherein the first knob includes a protruding part configured to bias the lever part to elastically deform in response to the pressing operation being performed by the second stroke amount, so as to cause the lever part to press the engaged portion.

8. The switching device as claimed in claim 7, wherein the lever part includes an inclined surface configured to convert, in response to being pressed by the protruding part in the first direction, the pressing force from the protruding part to a biasing force in a horizontal direction, so as to elastically deform the lever part in the horizontal direction, and by elastically deforming in the horizontal direction, the lever part presses and elastically deform the engaged portion.

9. The switching device as claimed in claim 1, wherein the first knob and the holder are arranged to overlap in the first direction, and arranged at positions that overlap in plan view as viewed in the first direction.

10. The switching device as claimed in claim 1, wherein the decorative member functions as a second knob configured to receive another operation different from the pressing operation.

11. The switching device as claimed in claim 10, wherein the second knob is configured to be slidable in a plurality of sliding directions crossing the first direction, in response to receiving the operating force from the operator, and includes a slide member provided to be connected with the second knob, and configured to slide in a sliding direction from among the plurality of sliding directions, upon transmission of the operating force applied to the second knob, a support member configured to support the slide member to be slidable in the sliding direction, a drive member rotatably supported by the support member, and configured to rotate as the slide member slides, and a slide detection switch configured to receive a switching operation in response to rotation of the drive member, wherein the drive member and the slide detection switch are provided for each of the plurality of sliding directions, wherein the slide detection switch has a returning force, and wherein the drive member, the slide member, the second knob return to respective initial positions by the returning force from the slide detection switch, upon being released from the operating force applied to the second knob.

12. The switching device as claimed in claim 11, wherein the second knob is provided to be rotatable around a central axis parallel to the first direction, in response to receiving an operating force from the operator when a rotating operation is performed, and includes a rotating member rotatably supported by the slide member, and configured to rotate as the second knob slides, and a rotation detection switch configured to receive a switching operation caused by rotation of the rotating member.

13. The switching device as claimed in claim 12, further comprising:

a case configured to contain the slide member, wherein the rotating member, the holder, or the second knob includes a restricted part, wherein the case includes a first restricting part configured to restrict rotation of the second knob upon being engaged with the restricted part, in a state of the slide member sliding in response to the second knob being operated in the sliding direction, and a second restricting part configured to restrict sliding of the slide member upon being engaged with the restricted part, in a state of the rotating member during rotation.

14. The switching device as claimed in claim 11, wherein the first knob includes a fitting protrusion extending toward the support member, and wherein the support member includes a fitting recess to be fitted to the fitting protrusion in response to the first knob moving toward the support member upon receiving the pressing operation, so as to restrict sliding of the second knob in a state of the first knob receiving the pressing operation.

* * * * *